US006772840B2

(12) United States Patent
Headworth

(10) Patent No.: US 6,772,840 B2
(45) Date of Patent: Aug. 10, 2004

(54) METHODS AND APPARATUS FOR A SUBSEA TIE BACK

(75) Inventor: Colin Stuart Headworth, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/252,614

(22) Filed: Sep. 23, 2002

(65) Prior Publication Data

US 2003/0056954 A1 Mar. 27, 2003

Related U.S. Application Data

(60) Provisional application No. 60/323,917, filed on Sep. 21, 2001.

(51) Int. Cl.[7] ..... E21B 29/12

(52) U.S. Cl. ..... 166/302; 166/57; 166/366; 166/367; 405/129.27

(58) Field of Search ..... 166/357, 368, 166/362, 366, 52, 302, 303; 405/129.27, 129.2, 170, 224.2; 285/41

(56) References Cited

U.S. PATENT DOCUMENTS

| | | | | | |
|---|---|---|---|---|---|
| 2,911,047 | A | * | 11/1959 | Hendersen | 166/61 |
| 3,180,437 | A | | 5/1961 | Kellner et al. | 175/230 |
| 4,484,641 | A | * | 11/1984 | Dismukes | 175/61 |
| 4,556,340 | A | * | 12/1985 | Morton | 405/224.2 |
| 4,679,598 | A | * | 7/1987 | Jee | 138/103 |
| 5,060,737 | A | | 10/1991 | Mohn | 175/104 |
| 5,285,846 | A | * | 2/1994 | Mohn | 166/61 |
| 5,828,003 | A | * | 10/1998 | Thomeer et al. | 174/69 |
| 5,908,049 | A | * | 6/1999 | Williams et al. | 138/125 |
| 5,913,337 | A | | 6/1999 | Williams et al. | 138/125 |
| 5,921,285 | A | | 7/1999 | Quigley et al. | 138/125 |
| 5,988,702 | A | | 11/1999 | Sas-Jaworsky | 285/249 |
| 6,003,606 | A | * | 12/1999 | Moore et al. | 166/381 |
| 6,004,639 | A | | 12/1999 | Quigley et al. | 428/36.3 |
| 6,026,911 | A | | 2/2000 | Angle et al. | 175/24 |
| 6,065,540 | A | * | 5/2000 | Thomeer et al. | 166/297 |
| 6,142,707 | A | * | 11/2000 | Bass et al. | 405/158 |
| 6,253,855 | B1 | * | 7/2001 | Johal et al. | 166/367 |
| 6,257,332 | B1 | * | 7/2001 | Vidrine et al. | 166/250.15 |
| 6,296,066 | B1 | * | 10/2001 | Terry et al. | 175/92 |
| 6,318,470 | B1 | | 11/2001 | Chang et al. | 166/377 |
| 6,349,763 | B1 | | 2/2002 | Estep et al. | 166/66.4 |
| 6,371,693 | B1 | * | 4/2002 | Kopp et al. | 405/158 |
| 6,386,290 | B1 | * | 5/2002 | Headworth | 166/346 |
| 6,419,018 | B1 | * | 7/2002 | Naquin et al. | 166/302 |
| 6,497,290 | B1 | * | 12/2002 | Misselbrook et al. | 166/384 |
| 6,527,053 | B2 | * | 3/2003 | Friisk | 166/346 |
| 6,615,848 | B2 | * | 9/2003 | Coats | 134/22.11 |

OTHER PUBLICATIONS

Andrzej A. Kaczmarski et al, *Emergence of Flow Assurance as a Technical Discipline Specific to Deepwater: Technical Challenges and Intergration into Subsea Systems Engineering*, OTC 13123, 2001.

David B. L. Walker, et al, *The Challenges of Deepwater Flow Assurance: One Company's Perspective*, OCT 13075, 2001.

* cited by examiner

*Primary Examiner*—Thomas B. Will
*Assistant Examiner*—Thomas A Beach
(74) *Attorney, Agent, or Firm*—John W. Wustenberg; Colin A. Rose

(57) ABSTRACT

A flow assurance system includes an inner pipe disposed within an outer pipe to assure flow through the outer pipe. During installation and relative axial movement with the outer pipe, the inner pipe is nearly neutrally buoyant or fully neutrally buoyant in the fluids of the outer pipe and may extend partially or completely through the outer pipe. The inner pipe may be anchored at one end within the outer pipe. The inner pipe is preferably composite coiled tubing that is installed using a propulsion system. The system may allow fluids to flow through the inner pipe and commingle with the fluids in the outer pipe or may flow fluids through the inner pipe to the exterior of the outer pipe. Hot fluids may pass through the inner pipe to maintain the temperature of the fluids flowing through the outer pipe and chemicals may flow through the inner pipe to condition the fluids in the outer pipe. Tools may be attached to the end of the inner pipe for conducting flow assurance operations within the outer pipe.

27 Claims, 16 Drawing Sheets

METHODS AND APPARATUS FOR A SUBSEA TIE BACK

CROSS-REFERENCE TO RELATED APPLICATIONS

The present application claims the benefit of 35 U.S.C. 111(b) provisional application Ser. No. 60/323,917 filed Sep. 21, 2001, and entitled Method and Apparatus for a Subsea tie back.

STATEMENT REGARDING FEDERALLY SPONSORED RESEARCH OR DEVELOPMENT

Not Applicable.

BACKGROUND OF THE INVENTION

The present invention relates to apparatus and methods for a subsea tie back and more particularly to a pipe disposed within the flowline for conducting flowline operations and still more particularly to methods for treating a flowline utilizing the inner pipe.

Subsea tie backs are flowlines tying back the trees of producing wells in producing field to a processing facility. The production facility processes the well fluids received through the producing well flowlines by separating the gas from the oil and by removing unwanted constituents such as gas and water, which at low temperatures and pressures, form undesirable hydrates. The conditioned and stabilized oil is either pumped through an export pipeline or transported by tanker. Typically there is a separate gas line for the produced gas.

Referring now to FIG. 1, there is shown a typical tie back system that includes a production facility 10 on an offshore platform 11 with two insulated tie back flowlines 12, 14 extending to a subsea manifold 16. The manifold 16 is many miles from the production facility 10. There are a plurality of christmas trees 18 in an oil field 20 having individual flowlines 21 extending from each tree 18 to manifold 16 where the production from each well is commingled. Electrical and hydraulic control umbilicals 22, 24, respectively, extend from platform 11 to manifold 16 to control the operation of manifold 16. Particularly, the control umbilicals control valves on manifold 16 and trees 18 as well as the chokes (not shown) in the individual christmas trees 18. A chemical injection line 26 also extends from the platform 11 to the manifold 16 and communicates with the flowlines 12, 14 for chemical treatment in the flowlines 12,14 and in the wells.

The production from each of the trees 18 passes to the manifold 16 and then is commingled for passage through the dual flowlines 12, 14 to the production facility 10 on platform 11. The production from field 20, of course, is raw production well fluids. The production facility 10 processes the crude produced by the trees 18 by removing, as for example, any water and gas in the well fluids such that only oil remains to be exported by an export pipeline 28 to shore. Instead of an export pipeline, a floating production, storage and offtake (FPSO) vessel may be used which not only process the well fluids but also stores the oil and gas for off loading. The production needs to be stabilized before it is exported either through the export pipeline 28 or the export vessel. To stabilize the crude means to place the oil in condition to put it in the export pipeline 28 and pump it a great distance. Although only field 20 is shown in FIG. 1, production facility 10 may also receive the production from other surrounding fields, such as oil fields 30, 32.

Although FIG. 1 shows the platform 11 supported by the sea floor 34, production now is occurring in deep water. Deep water is typically where the water depth is over 1,000 meters. In 1,000 meters of water, the production facility 10 would be on a floating platform anchored to the ocean floor or on a vessel. In deep water, the production facility 10 must be a floating facility such as a SPAR, a TLP (Tension Leg Platform) or an FPSO.

Using subsea flowlines to tieback subsea wells to a remote processing facility is an established method for developing oil and gas fields. The design and specifications of the subsea flowlines is driven by the needs of flow assurance management. Flow assurance management includes ensuring that the unprocessed well fluids: (1) are able to reach the process facility; (2) arrive at the process facility above critical temperatures (such as the wax appearance temperature or cloud point and the hydrate creation temperature); (3) can be made to flow again after planned or unplanned shutdown (particularly with respect to clearing hydrate blockages); (4) avoid hydrates, wax, asphaltene, scale, sand, and other undesirable contents from building up in the flowline; and (5) can be made to flow at a range of driving pressures, flowrates, and compositions. See "Emergence of Flow Assurance as a Technical Discipline Specific to Deepwater Technical Challenges and Integration into Subsea Systems Engineering" by Kaczmarski and Lorimer of Shell, OTC 13123 Apr. 3, 2001.

The typical methods used to achieve the many different demands of flow assurance include using highly insulated flowlines, pipe-in-pipe flowlines, active heating of flowlines, and dual flowlines. These approaches have a high cost, however. The oil industry therefore is continually attempting to increase tieback distances and to reduce costs. The challenge is to have longer tieback distances while at the same time achieving acceptable costs. This is proving difficult for the industry, especially because subsea tiebacks tend to be the approach used for the smaller reservoirs (which demand lower costs.) Deeper water exacerbates the difficulties of subsea tie backs with the added disadvantage that it is much easier for hydrates that can block the flowlines to form in deep water. See "The Challenges of Deepwater Flow Assurance: One Company's Perspective" by Walker and McMullen of BP, OTC 13075 dated Apr. 30, 2001.

Wax in the well fluids builds up on the inner surface of the flowline over time unless the temperature of the well fluids is maintained above the wax appearance temperature, i.e. the cloud point where particles appear in the liquid turning the liquid cloudy. The wax appearance temperature varies between 50 and 120° F. depending upon well fluid properties. It is important that the well fluids maintain a high temperature, i.e. are hot, as they pass through the flowline from the manifold 16 to prevent the wax from plating up the flowline. However, sometimes the cooler temperatures can not be avoided. For example, the well fluids adjacent the wall of the flowline are cooler than the bulk of the fluid passing through the central portion of the flowline. Thus, the wax will tend to plate up on the inner surface of the flowline where the temperatures are cooler, i.e., below the wax appearance temperature. Other undesirable constituents of the well fluids, such as asphaltene, scale, and sand, also tend to build up in the flowline.

A subsea tie back preferably provides for the use of a pig to be pumped through the flowline to remove the wax, asphaltene, scale, sand and other constituents in the well fluids that tend to build up in the flowline. "Pig" stands for pipeline inspection gauge. Dual flowlines with an end-toend loop are preferred to provide a full circuit for the pig so that the pig can pass through the flowline from the production platform, through the tie back flowline, and then back to the production platform. Scraper pigs run through the flowline to remove wax and other build up on the inside of the flowline and are run at a frequency depending upon the fluids and other conditions.

Intelligent pigs can also be used to inspect the inside of a flowline. In most typical intelligent pigging, the pig flows through the flowline and the information gathered by the pig is discerned after the pig has passed through the flowline. If all the necessary information has not been gathered, then it is necessary to run the pig back through the flowline, particularly over a certain area of the flowline which is of concern. It would be preferred to have a system that provides "real time" information as the pig passes through the flowline. Real time information allows the operator to see the information gathered by the pig in real time as the pig passes through the flowline. This permits the operator to also control the inspection tools that are carried with or are part of the intelligent pig.

The undesirable constituents of the well fluids, such as wax, asphaltene, scale, and sand, may also be prevented or removed with chemicals. Chemicals may be injected continuously into the flowlines 12, 14 through chemical injection line 26. The chemicals condition the well fluids to prevent the formation of wax on the walls of the flowlines 12, 14. Continuous injection of chemicals, however, is a huge expense.

A problem during shut in of production is that the well fluids themselves become gel-like, i.e. very viscous, when the well fluids reach their pour point temperature. Thus, if the well fluids dip below the pour point temperature, they become very viscous and it may be difficult to restart flow.

Another problem, particularly when flow through the flowlines in shut down, is the formation of hydrates. Hydrates are a solid form of a mixture of the gas and water in the well fluids at a certain temperature and pressure. Hydrates can be produced from methane, carbon dioxide, nitrogen, or other gas with water in the well fluids to form a crystalline structure. Hydrates form instantly into a solid to block and close the flowline to flow. For example, if there is an unexpected shut in, the well fluids in the flowlines begin to cool down. After a cooling down period, the well fluids then go into the hydrate region of temperature and pressure. The gas may collect at the high points in the flowline and the water may collect at the low points in the flowline. However, once flow is started again the gas and water mix to instantly form hydrates and block the flowline.

Hydrate chemistry is very complex. It becomes even more complex because of all the different types of fluids being produced in the well fluids. Thus, it is difficult to know exactly what kind of hydrates will form and how they will form. Further, because it occurs in a subsea pipeline, it is difficult to know exactly how the hydrates form and what causes them to form. The chemistry is much simpler if the fluids are just water and gas, but when the fluids also include oil and other chemicals such as salts, the hydrate chemistry becomes very complex. The mechanisms of hydrate formation in liquids makes it complex, particularly when hydrates can be formed with gas in the liquid oil. Hydrate problems in pipelines are well known in the industry.

Although the system is designed for normal operation, there may be an unexpected or unplanned event that requires production to be shut in and flow through the flowline stopped. No matter how much or what kind of insulation has been used around the flowline, once flow stops, eventually the well fluids in the flowline will reach the same temperature as the surrounding sea water, typically 40 to 50° F. Thus, the temperature of the well fluids drops under the wax appearance temperature and hydrate formation temperature.

Thus, it is important to take steps to keep the temperature of the well fluids above the hydrate appearance temperature as well as above the wax appearance temperature. One method of maintaining the temperature of the hot produced well fluids is to insulate the flowlines. For example, the flowline may be disposed within a larger diameter pipe to form dual concentric pipe. Insulation is disposed in the annular area between the inner flowline and outer pipe. Alternatively, heated fluid may be flowed through the annulus of the dual concentric pipe to heat the well fluids flowing through the inner flowline. However, even if the annulus is insulated, there is loss of heat to the sea water environment around the outer pipe. Although loss of heat may be reduced if the dual concentric pipe is buried in the sea floor, there will still be a loss of heat through the outer pipe into the subsea floor.

Dual concentric pipe is very expensive to lay and install on the ocean floor. This expense is even greater in laying such large pipe in deep water. The size and cost of the vessel to lay such pipe is extremely expensive and only a few vessels are available which can handle such large pipe.

Another method of maintaining the temperature of the well fluids is to heat the well fluids as they flow through the flowline. There are a number of methods to active heating of flowlines where an inner flowline is disposed within an outer pipe. One approach is to flow hot liquid, such as water, through the annular area between the flowline and outer pipe. Flow through the annular area may be continuous or it may be used only in a contingency. For example, hot liquid may be flowed after a shut down to heat the inner flowline and well fluids and to restart flow through the flowline. Another approach is to use a bundle of flowlines disposed in a large carrier pipe that might be 40 inches in diameter. One of the inner flowlines may carry hot fluids such as hot water. The bundle of pipes may also be insulated inside the carrier pipe. This pipe bundle is built on shore and then towed off shore for installation. A still another approach is the use of electric heating of flowlines. Electric heating is disposed between the inner flowline and outer pipe and is then used in case of a contingency.

Although a pipe carrying hot liquids disposed inside an outer pipe is known to have preferred thermodynamic properties, installing an smaller pipe inside an outer pipe is time consuming and expensive. One method is to install the inner pipe within the outer pipe as sections of the outer pipe are being connected for assembly, although such an assembly and installation would be very expensive.

Also, pigging is a normal requirement for flowlines and a pig cannot be pumped through the flowline if there is an obstruction within the flowline such as an inner pipe. A pig is a solid object that passes through the flowline when pushed by the flow of fluid in the flowline. Thus, all flowlines are typically designed so that they can be pigged, this being a normal design parameter. Still further, a pipe inside the flowline raises a serious corrosion issue since an inner pipe creates stagnant areas inside the flowline causing serious corrosion sites due to water and debris collecting and forming strong electrolytes and creating galvanic cells. Thus, no one has considered placing something inside the flowline for flow assurance because that would interfere with the passage of a pig through the flowline. Thus, putting an inner pipe inside the flowline is a complete anathema to present flowline design because something inside the flowline means it cannot be pigged.

To mitigate against an unplanned shut down, chemicals, such as methanol, are flowed from the production facility 10, through the chemical injection line 26, and into the flowlines 12, 14 to commingle with the well fluids in an attempt to prevent the well fluids from forming hydrates. The volume of methanol required is a function of the percentage of water in the well fluids. As the percentage of water in the flow increases over the life of the well, the volume of methanol required eventually becomes so large as to be impractical and too expensive.

Flowlines are designed to ensure that flow is never blocked in the flowline. This is because the only solution to a blocked flowline is to replace the flowline completely. A design that ensures that there is never any blockage in the flowline is very expensive, however. For example, having inner and outer pipes laid by expensive vessels adds a substantial cost to install the flowlines. Chemical injection must also be available and installed for the flowline. Thus, the system must be designed for an unexpected shut down so as to ensure against blockage of flow at that time and avoid the expense of a new flowline.

The amount of production through the flowlines also varies over the life of the producing field. It takes many years to complete and produce all the wells in a field and thus a different number of wells may come on line at different times. This causes a variance in the amount of well fluids being produced. The flowlines must be installed early on after the initial wells are producing. Thus, the flow of the well fluids through the flowlines changes over time. For example, the amount of flow and the pressure of the produced fluids changes, the amount of water in the well fluids changes, and the amount of gas changes. Thus, over the life of the well, there is a large a range of flows and compositions of well fluids through the flowlines. These changes must be coped with by the flowlines.

Still another problem encountered in existing systems is that the flowlines are designed to be full of well fluids flowing to the process facility. However, the driving pressure of the well fluids and the flow rate of the well fluids may vary as well as the composition of the well fluids. The term "driving pressures" relates to the turn down of production and thus flow through the flowlines. The variation in flow rate also causes a variation in the temperature of the well fluids. There are chokes in the trees 18 that control the amount of well fluids being produced in each of the wells to control the production from the reservoir in field 20. The manifold 16 may be mixing different well fluids being produced from different reservoirs where the composition of the well fluids in the reservoir may be different. These are all controlled in an attempt to maximize production.

However, the flowlines have a certain size and a certain hydraulic capability. Thus, although the flowlines will be full of fluid, the flow rates and driving pressures will vary and the constituents of the well fluids will vary. The driving pressures and flow rates are related and the arrival temperature of the fluids at the production facility is also related. The industry standard program for analyzing the flow through the flowlines is called "OLGA". This is used to analyze the flow through the flowline to achieve the proper flowline design.

The two flowlines 12, 14, shown in FIG. 1, are "dual flowlines" because they are basically side by side. Dual flowlines allow the operator to change the amount of flow from the manifold 16 to the production facility 10 by shutting down one of the flowlines. It also provides a broader range of flow rates, pressures, and temperatures. By closing one of the lines down, the cross-sectional flow area is changed. Because production from a field deteriorates over time, ultimately, only one of the two flowlines may be used for transporting the well fluids from the manifold 16 to the production facility 10. This is called "turn down". The two lines provide more flexibility in the management of the flow and also allow "turn-down" as needed. Also, one of the flowlines may be a back-up, such that if one of the flowlines is blocked, the other flowline is still available for production.

Dual flowlines also allow round trip pigging. The two flowlines 12, 14 include valves at the manifold 16 so that production can be shut off in a particular flowline 12, 14 and a pig sent through the line beginning at the platform 11 to travel from the platform 11 to the manifold 16. The pig then returns through the other producing flowline to platform 11.

As production of the field matures, the production of the field depletes such that the processing facility is no longer fully utilized. It is preferred to use the spare capacity of the processing facility and thus, it is desirable to tie back the processing facility with other producing fields so that the processing facility is fully utilized. These other fields may be many miles away from the processing facility. Thus, there is the need for subsea tie back flowlines to extend many miles across the ocean floor to reach various producing fields around the processing facility and process a plurality of producing fields. It is cheaper to use existing process facilities and use subsea tie backs than to build new production facilities.

One objective is to be able to build subsea tie back flowlines that are up to 100 miles long. The ultimate objective is to have the production facility onshore with tie back flowlines extending from shore out to the subsea manifolds. Thus, one production facility could process production from all fields within 100 mile radius. This would provide substantial cost savings in deep water production.

The present invention overcomes the deficiencies of the prior art.

SUMMARY OF THE INVENTION

The methods and apparatus of the present invention include an inner pipe disposed within an outer pipe for the purpose of assuring flow through the outer pipe. The inner pipe may extend partially or completely through the outer pipe and may be installed into the outer pipe at any point along the length of the outer pipe. Further, the inner pipe may be installed into the outer pipe without regard to whether there are fluids passing through the outer pipe. It also should be appreciated that more than one inner pipe may be disposed within the outer pipe.

The inner pipe may be either a jointed pipe or preferably a continuous pipe. The inner pipe plus its contents are nearly neutrally buoyant or fully neutrally buoyant such that when in the fluids of the outer pipe, the inner pipe plus its contents have substantially the same density as the fluids in the outer pipe. This substantially neutrally buoyancy allows the inner pipe to minimize friction against the outer pipe upon inserting and installing the inner pipe within the outer pipe and allows the inner pipe to be installed at great distances within the outer pipe. The fluids used during installation are selected to achieve neutral buoyancy. Once installed, the fluids within the pipes can be changed from the fluids used during installation to the fluids used during production operations. During production operations, however, it is not necessary for the inner pipe to be substantially neutrally buoyant.

The jointed pipe may be either a metal or composite tube having segments connected together and installed using snubbing techniques. The continuous inner pipe is either a metal or composite coiled tubing. If metal coiled tubing, the metal coiled tubing is made substantially neutrally buoyant with selected fluids inside and out. If a composite coiled tubing, the composite coiled tubing is engineered for the required mechanical properties required for flow assurance within the outer pipe and particularly is engineered to be substantially neutrally buoyant with selected fluids inside and out. In a most preferred composite coiled tubing, conductors and fiber optic cables are embedded in the wall of the composite coiled tubing to provide power and communication through the wall of the coiled tubing. Electrical conductors may be used to power a tool attached to the end of the inner pipe and the communication conductors may be used to monitor temperature and pressure along the length of the inner pipe. Further, the conductors may be used to transmit signals and data through the wall of the pipe either from a tool or other assembly connected to the end of the inner pipe. The coiled tubing may be installed using coiled tubing techniques and inserted and installed at any point along the outer pipe such as through connection points in the outer pipe.

Several motive means may be used individually or in combination to install the inner pipe within the outer pipe. The hydrodynamics of the flow of fluids in the outer pipe may be used to move the inner pipe in the same direction as the flow of fluids. Alternatively, a flow restriction member, such as a pig, may be attached to the end of the inner pipe to create a pressure differential for moving the inner pipe within the outer pipe. In a preferred embodiment, a propulsion system that engages the outer pipe is used to move the inner pipe through the outer pipe. The propulsion system may be either electrically or hydraulically powered. If hydraulically powered and installed over great distances, gas slugs may be passed through the inner pipe to maintain sufficient energy for driving the hydraulically powered propulsion system. The propulsion system may have a segmented housing allowing the propulsion system to pass through bends in the outer pipe.

The inner pipe may be anchored within the outer pipe such as by a latch mechanism or a friction coupling where the inner pipe frictionally engages the outer pipe.

The inner pipe may be used in various types of circuits. In an open circuit, one end of the inner pipe is open to the fluids flowing through the outer pipe such that the fluids passing through the inner pipe may mix and commingle with the fluids in the outer pipe. In one embodiment of a closed circuit, the end of the inner pipe communicates with the environment outside the outer pipe whereby the fluids flowing through the inner pipe do not mix and commingle with the fluids in the outer pipe and are allowed to flow through the inner pipe and into the environment around the outer pipe. In another embodiment of the closed circuit, the end of the inner pipe may communicate with a return line exterior to the outer pipe. In still another embodiment of the closed circuit, a pair of inner pipes communicating through a connection at their free end are disposed with the outer pipe allowing fluids to flow through one inner pipe and then return through the other inner pipe.

In one method of the present invention, hot liquids are pumped through the inner pipe to control the temperature of the fluids flowing through the outer pipe. In an open circuit, the fluids pumped through the inner pipe are compatible with the fluids in the outer pipe so that they may be mixed and commingled. In a closed circuit, the liquids passing through the inner pipe are compatible with the environment around the outer pipe. In still another closed circuit, the hot fluids may be any available fluids that can be circulated through an inner pipe and a return pipe.

In another method of the present invention, liquids with different densities may be passed through the inner pipe causing the inner pipe to move up and down inside the outer pipe, thereby stirring up any stagnate fluid areas. The inner pipe may also be reciprocated within the outer pipe to stir up any stagnate fluid areas.

In another method of the present invention, in an open circuit, chemicals may be pumped through the inner pipe to mix with the fluids in the outer pipe so as to condition the fluids in the outer pipe. In another embodiment using a closed circuit, the inner pipe may include a series of valves that may be selectively opened to allow liquids inside the inner pipe to mix with fluids in the outer pipe at one or more locations along the outer pipe.

In another method of the present invention, a tool may be attached to the end of the inner pipe to clean the interior of the outer pipe.

In another method of the present invention, the inner pipe may be used to depressurize the fluids in the outer pipe to prevent the formation of a blockage due to undesirable components of the well fluids solidifying within the outer pipe.

In another method of the present invention, the inner pipes may be used in an open circuit to mix chemicals with the fluids in the outer pipe to allow the fluids in the outer pipe to be pumped after flow has been stopped.

In another method of the present invention, a pair of inner pipes may be disposed within the outer pipe with one of the pipes passing fluids at high velocity therethrough and with the other pipe being a return pipe pumping undesirable contaminates, such as sand, in the fluids from the outer pipe.

In still another embodiment of the present invention, an inspection tool may be disposed on the end of the inner pipe and connected to conductors in the walls of the inner pipe such that a real time internal inspection may be conducted of the outer pipe.

In still another embodiment of the present invention, a first inner pipe may be disposed within a non-bonded flexible outer pipe to prevent compression of the outer flexible pipe. The first inner pipe may include a flexible gooseneck on the end thereof to negotiate any bends. A second inner pipe may then be inserted inside the first inner pipe and further extended through the flexible gooseneck such that the second inner pipe may be inserted into a flowline connected to the nonbonded flexible outer pipe.

In still a further method of the present invention, the inner pipe may be used to transport the fluids in the outer pipe should flow through the outer pipe be reduced. Further, the inner pipe may be substituted with another inner pipe having either a smaller or larger diameter to adjust the flow area either through the inner pipe or through the annulus formed between the inner pipe and the outer pipe.

The methods and apparatus of the present invention are particularly applicable to subsea tie backs with the inner pipe being used for a variety of flow assurance operations to ensure flow through a flowline. In particular, the inner pipe may be used to either avoid or remove hydrates, wax, asphatene, scale, sand, or other desirable constituents of the well fluids flowing through the flowline.

BRIEF DESCRIPTION OF THE DRAWINGS

For a detailed description of a preferred embodiment of the invention, reference will now be made to the accompanying drawings wherein.

Figure 1:
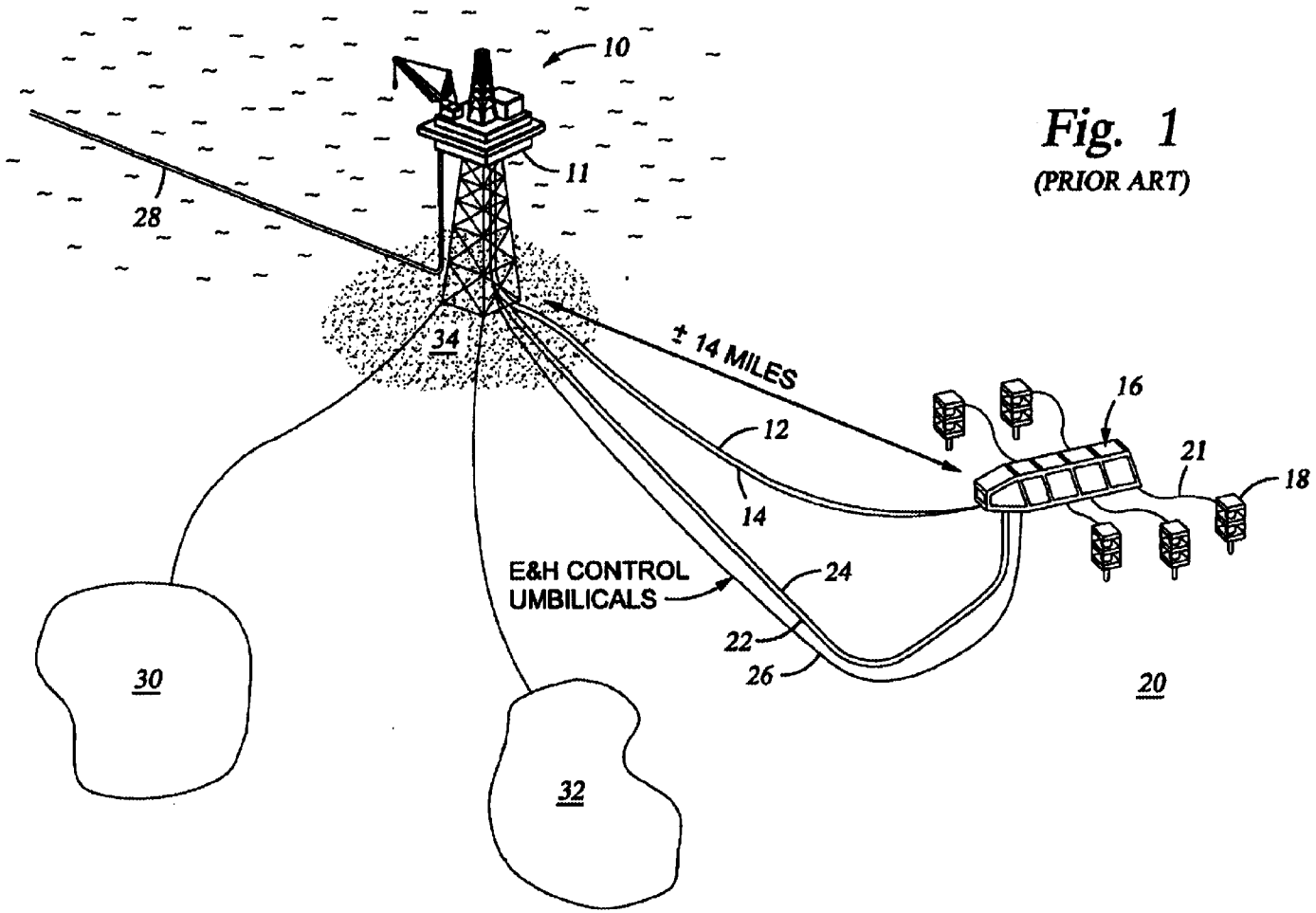
Fig. 1 (PRIOR ART)
FIG. 1 is a schematic view of a prior art subsea tie back.

The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

DETAILED DESCRIPTION OF THE PREFERRED EMBODIMENT

The methods and apparatus of the subsea tie back system of the present invention preferably include an inner pipe disposed within a outer flowline. Various embodiments of the present invention provide a number of different constructions of the inner pipe, each of which is used with a flowline in one of many different types of flowline installations and production facilities. The embodiments of the present invention provide a plurality of methods for using the inner pipe for flow assurance of well fluids through a flowline. It is to be fully recognized that the different teachings of the embodiments discussed below may be employed separately or in any suitable combination to produce desired results in flow assurance. In particular the present system may be used in practically any type of new or existing flowline. Reference to "up" or "down" are made for purposes of ease of description with "up" meaning towards the sea surface and "down" meaning towards the bottom of the sea floor.

The application of the apparatus and methods of the present invention is described in detail with respect to flow assurance in subsea tie back flowlines. However, many of the embodiments may find applications in other types of pipeline systems, such as export pipelines. Another example application includes the use of the present invention in real-time inspection in pipelines.

In the following description, like parts are marked throughout the specification and drawings with the same reference numerals, respectively. The drawing figures are not necessarily to scale. Certain features of the invention may be shown in exaggerated in scale or in somewhat schematic form and some details of conventional elements may not be shown in the interest of clarity and conciseness.

Figure 2:
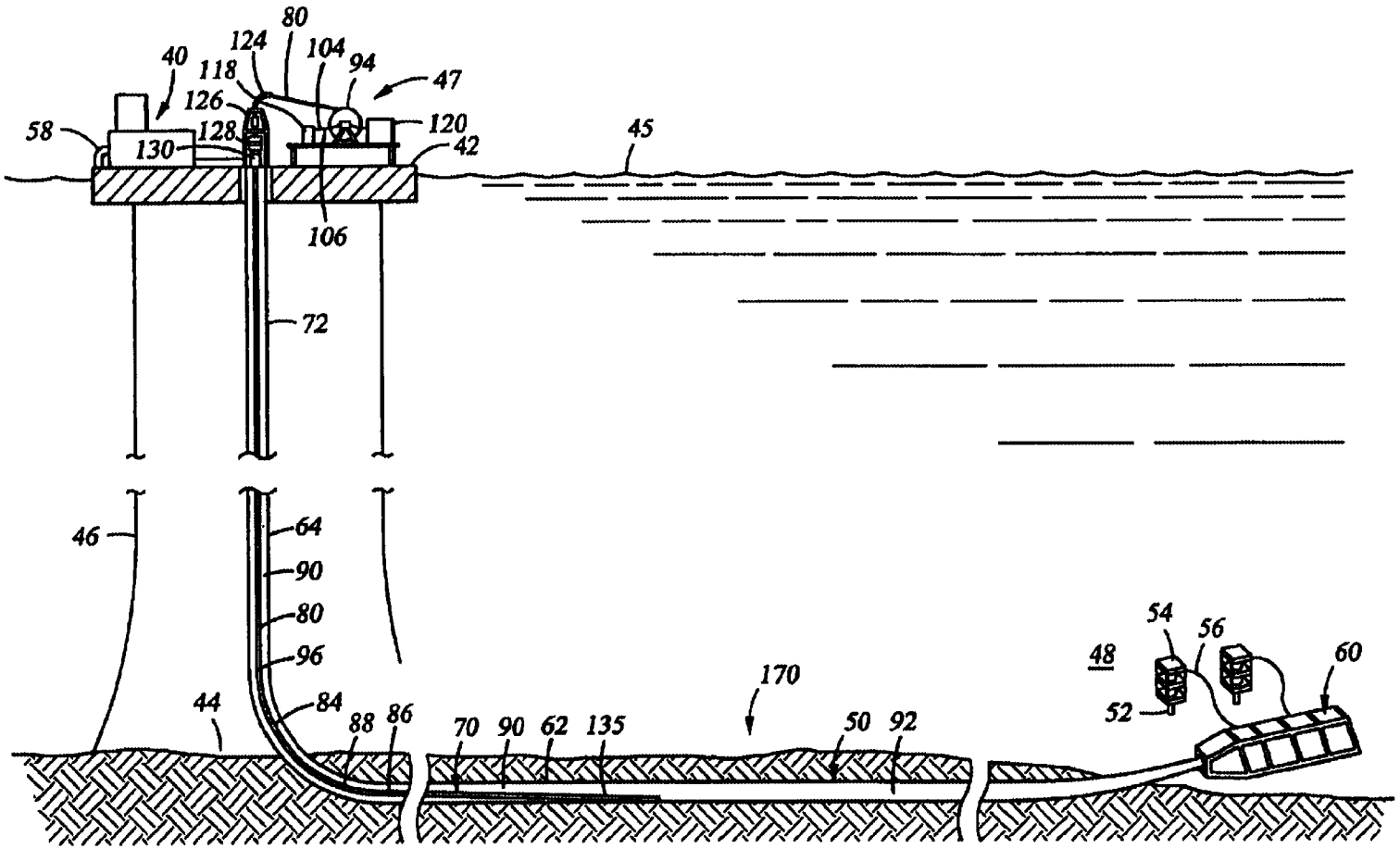
FIG. 2 is an elevational schematic, partly in cross-section, showing an open circuit subsea tie back of the present invention with a continuous inner pipe.
Figure 3:
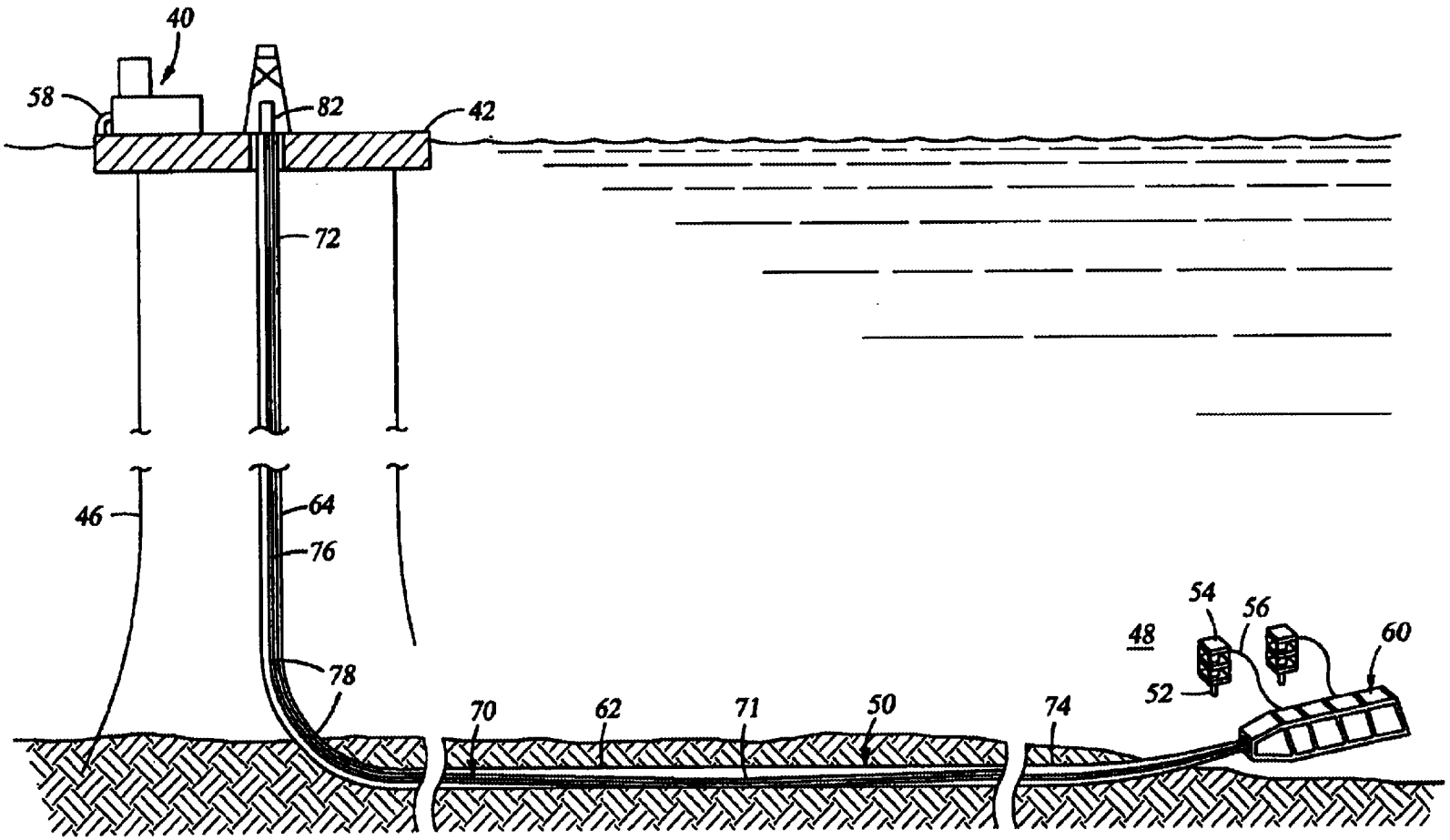
FIG. 3 is an elevational schematic, partly in cross-section, showing a subsea tie back of the present invention with a jointed inner pipe.

Referring initially to FIGS. 2 and 3, there is shown an exemplary operating environment for two embodiments of the subsea tie back system of the present invention. A production facility 40 is disposed on a platform 42. In deep water, the platform 42 may be a floating platform, such as a SPAR or a tension leg platform anchored to the ocean floor 44 by wire lines 46, or another type of floating vessel such as a floating production storage and off take vessel (FPSO). Production facility 40 processes well fluids produced from preferably a plurality of fields, such as field 48 including a plurality of producing wells 52 each having a Christmas tree 54 with an individual flowline 56 extending from each tree 54 to a manifold 60 where the well fluids produced from wells 52 are commingled for transport to production facility 40. It should be appreciated that manifold 60 and trees 54 have a plurality of valves for controlling flow and that the trees 54 include production control equipment, such as chokes and blowout preventers, to control the operation of manifold 60 and the production of wells 52, as is well known in the art.

A subsea tie back flowline 50 extends from subsea manifold 60 back to platform 42 and includes a generally horizontal portion 62 connected to or as an integral part of a riser portion 64 extending from the sea floor 44 to the platform 42. Flowline 50 preferably has an outer layer of insulation, such as thermotite insulation, and is also preferably buried under sea floor 44 for protection and additional insulation. Ideally the flowline 50 is buried in a trench and then covered over. The sea bed 44 provides a natural insulation around flowline 50 because of its thermal mass. Manifold 60 may be disposed many miles from the production facility 40. It should be appreciated that although only one manifold and flowline are shown for clarity, there may be a plurality of manifolds and producing fields with well fluids being pumped to production facility 40 for processing.

The production from field 48 is raw production well fluids, ie., crude oil, requiring processing before being exported. The production facility 40 processes the crude produced by wells 52 by removing, as for example, any water and gas from the well fluids, such that only oil remains to be exported either by an export pipeline 58 or, instead of an export pipeline, by a FPSO vessel that may be used to not only process the well fluids but also to store the oil and gas for off loading. To export the oil in the export pipeline 58 and pump it a great distance, the oil needs to be stabilized to place the oil in condition for export either through export pipeline 58 or an export vessel. The gas may be exported by a separate pipeline.

The subsea tie back system of the present invention includes a pipe 70 disposed within flowline 50. Inner pipe 70 is a part of the flow assurance for the flowline 50 and may be used for a plurality of flow assurance operations including but not limited to heating the well fluids, reducing the pressure head in the riser 64, dispersing chemicals in the well fluids such as to prevent hydrate formation or wax formation, or to remove undesirable build up in the flowline 50 that must be removed as hereinafter further described in more detail. The inner pipe 70, for example, may have a diameter from 1 to 6 inches and the production flowline 50, for example, may have a diameter of between 4 inches and 20 inches for the purpose of providing flow assurance management.

Inner pipe 70 may be disposed within flowline 50 for flow assurance at any time during the life of the field 48 and may remain inside flowline 50 for any period such as for hours, days, weeks, months, and years, up to and including the full life of the field 48. The period of time that the inner pipe 70 remains inside flowline 50 depends upon the methods and operations to be carried out using inner pipe 70. It may be used merely as an emergency measure to clear the flowline 50 of clogging or stoppage and thus disposed in flowline 50 for a short period of time. It also may be a part of a remediation effort. For example, it could be used to heat the well fluids towards the end of flowline 50 to ensure that the well fluids reach the production facility 40 at a predetermined high temperature. Inner pipe 70 could also be part of the design of the production facility 40 and be a permanent part of the installation. The inner pipe 70 may be used on existing production and flowline facilities or incorporated into new production and flowline facilities.

Inner pipe 70 may be inserted any distance into flowline 50. Thus, it is not necessarily preferable to install the inner pipe 70 the entire length of the flowline 50. The inner pipe 70 needs to be installed only a sufficient length in the flowline 50 and at a predetermined location in the flowline 50 to ensure flow assurance and particularly no stoppage of the flowline. Thus, the optimum distance and location is determined by the flow assurance requirements of each particular reservoir or field. For example, the inner pipe 70 can be inserted a partial distance into the flowline 70 as shown in FIG. 2 or can be inserted the full length of the flowline 70 as shown in FIG. 3. Inner pipe 70 may need only be inserted in that portion of the flowline 50 requiring flow assurance measures, e.g., that portion of flowline 50 where the temperature of the well fluids is too low, where the pressure head in the riser 64 must be reduced, where chemicals must be dispersed into the well fluids, or where the is undesirable build up of wax, scale, sand, or asphaltene in the flowline 50.

Inner pipe 70 may be inserted and installed into flowline 50 at any point along flowline 50. For example, pipe 70 may be inserted into the downstream end 72 of flowline 50 at the top of flowline riser 64, such as shown in FIG. 2; at the upstream end 74 of flowline 50, such as shown in FIG. 3; or anywhere in between, such as at medial portion 75 shown in FIG. 6. The point of installation of inner pipe 70 depends upon a number of factors. Preferably the inner pipe 70 will be installed from the downstream end 72 from platform 42 where there is easier access to inner pipe 70 and flowline 50. However, if the flowline 50 is 100 miles long, there will preferably be a plurality of insertion points along flowline 50 through which lengths of inner pipe will be inserted and installed. Further, it is possible that inner pipe cannot be installed from the downstream end at an existing facility and the inner pipe 70 must be inserted and installed from the upstream end 74.

It should be appreciated that the inner pipe 70 may be installed from a floating vessel such that it may be inserted at any point along the flowline 50. One method of installation is the use of a Swift Riser described in U.S Pat. No. 6,386,290 B1 and entitled "A System for Accessing Oil Wells with Compliant Guide and Coiled Tubing". The Swift Riser is a method that allows the use of coiled tubing on a reel on the vessel with the coiled tubing injected into the flowline.

The inner pipe 70 may be inserted and installed into flowline 50 whether flowline 50 is pressurized and has flowing well fluids or is not pressurized and well fluids are not flowing. Further, the well fluids may be flowing toward the point of insertion or away from the point of insertion of inner pipe 70. In certain instances, it is worthwhile to install inner pipe 70 from manifold 60 while the well fluids are flowing whereby the flowing well fluids assist the installation of the inner pipe 70 since it is easier to insert inner pipe 70 in the direction of the flow of the well fluids.

Figure 13:
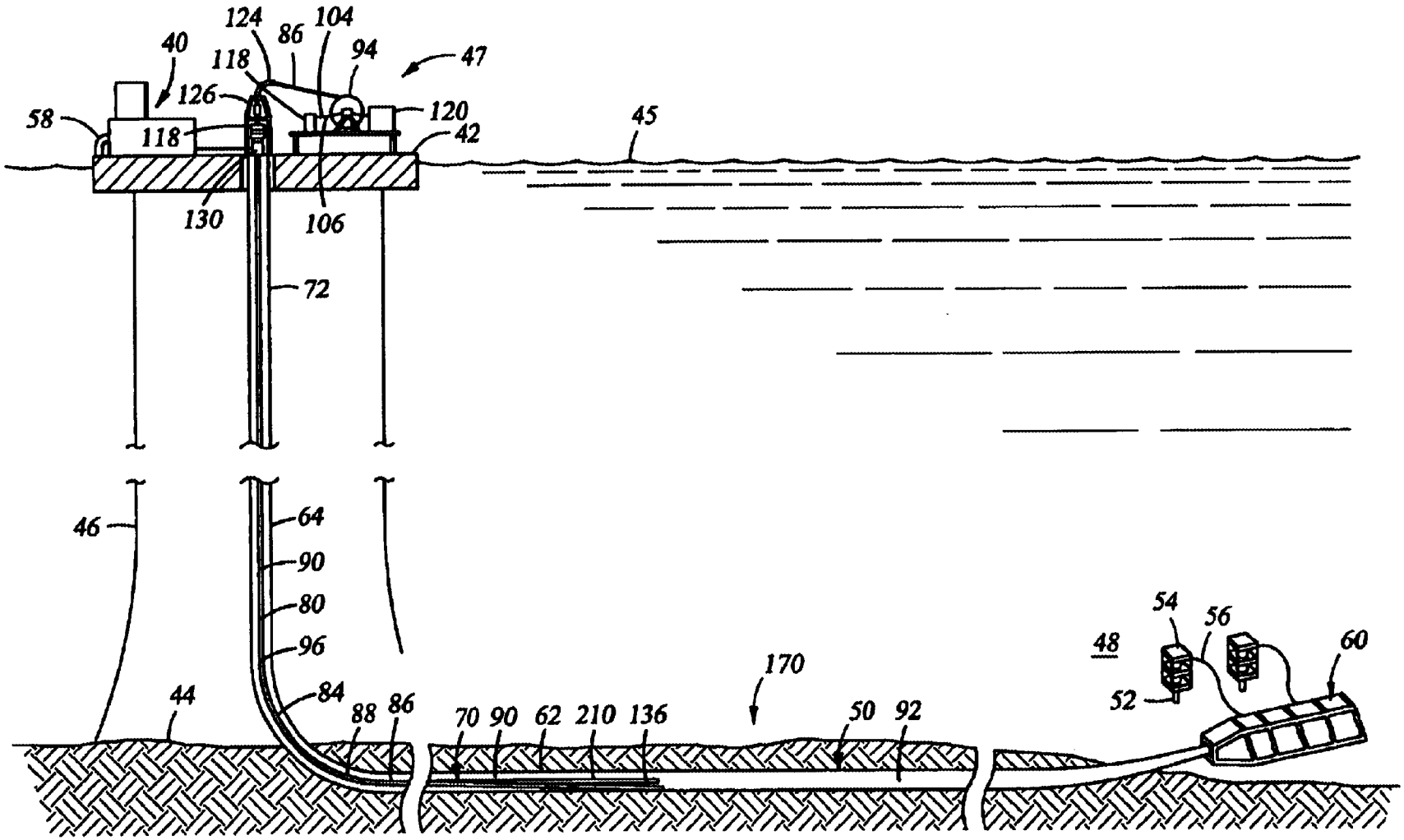
FIG. 13 is a elevational schematic, partly in cross-section, showing removal of sand using one or more inner pipes of the present invention.

It should be appreciated that a plurality of inner pipes 70, 71 as shown in FIGS. 3 and 13 can be disposed within flowline 50. For example, one or more of the additional inner pipes may include electrical control umbilicals, hydraulic control umbilicals, and/or chemical injection lines extending from platform 42 to manifold 60 as hereinafter described in further detail. Typically, control umbilicals are a bundle of small tubes and include electrical conductors as well as fiber optic cables. Typically this bundle is in armor to give the bundle weight to make it lay on the sea bed. If the umbilicals were inside the flowline 50, armor would not be required for the umbilicals to otherwise give it weight and protection.

In a new installation, the chemical injection line of prior art installations would typically lie beside the flowline 50. This chemical injection line would provide chemicals to the trees and the wells or chemical injection into the flowline 50 at the manifold 60. In the present invention, there may be a separate chemical injection line, such as inner pipe 71 shown in FIG. 3, that also passes through the flowline 50. If the inner pipe 71 also serves as the chemical injection line, then the end of the inner pipe 71 is docked at, or near, the manifold 60 to allow the inner pipe 71 to connect with the chemical injection ports that communicate with the manifold 60 and the trees 54.

Inner pipe 70 may be either a jointed pipe 76 as shown in FIG. 3 or a continuous pipe 80 as shown in FIG. 2. A jointed pipe 76 includes a plurality of lengths 78 of pipe connected together by connections 82 or welded together as the jointed pipe is installed. The continuous pipe 80 is preferably coiled tubing, as hereinafter described, and is preferred so as to avoid the multiple connections required for jointed pipe.

When being moved axially inside the flowline 50, it is preferred that inner pipe 70 plus its contents, taken together, be nearly neutrally buoyant or fully neutrally buoyant when in the fluid contents of flowline 50. In other words, the pipe 70 plus its contents preferably has substantially the same density as the fluids around it in flowline 50. Friction is a function of weight and if the inner pipe 70 is made substantially buoyant, the weight of inner pipe 70 then becomes nil within the flowline 50 as it is installed. It should be appreciated that the inner pipe 70 will only be substantially neutrally buoyant since buoyancy will change with changes to the well fluids and may be different at different locations of the flowline 50.

Friction between the inner pipe 70 and the inside of flowline 50 prevents the inner pipe 70 from extending a long distance. The weight of the inner pipe 70 acting against the inner surface 55 of the outer flowline 50 creates friction that limits the distance the inner pipe 70 can be inserted into the outer flowline 50. If the friction due to the weight of the inner pipe 70 is eliminated by buoyancy, then this resistance has been substantially reduced.

Friction not only creates a drag on the pipe if it is to be pulled into the flowline but it will cause the pipe to buckle if the pipe is being forced into the flowline. The furthest that metal coiled tubing has been inserted in a horizontal well is approximately 9,000 feet, but special wheels mounted on the tool were required. Metal coiled tubing is heavy and causes greater friction against the inner surface of the flowline thus limiting the distance that the pipe can travel in a horizontal flowline.

The inner pipe 70 has reduced utility if the inner pipe 70 can only be inserted into the horizontal portion 62 of flowline 50 a few thousand feet. The inner pipe 70 of the present invention has the advantage of being capable of being inserted into a horizontal flowline a very long distance, such as 100 miles, so that the flowline 50 itself can have a substantial length as compared to prior art flowlines.

Thus, inner pipe 70 together with its contents is preferably engineered to be substantially neutrally buoyant. The inner pipe 70 wall may have a gross density that is different to the gross density of the fluid inside. Preferably the inner pipe 70 is made of a composite that lends itself to be neutrally buoyant in the fluids in the flowline 50. However, metal jointed pipe or metal coiled tubing may also be made substantially buoyant such as by adding buoyancy to the metal pipe. See U.S. Pat. No. 4,484,641, hereby incorporated herein for all purposes. Potential fluids used for flow through the inner pipe 70 during installation or axial movement of the inner pipe 70 include, but are not limited to: (1) water; (2) seawater; (3) brine, such as calcium chloride or potassium chloride mixed with water; (4) diesel; (5) crude oil; (6) nitrogen; (7) polymer gel; (8) gelling agent; (9) surfactant; (10) foaming agent; (11) corrosion inhibitor; (12) lubricant; (13) chemicals to dissolve or loosen wax from the inner walls of the outer pipe 50; (14) chemicals to inhibit the formation of wax or hydrates in the outer pipe 50; (15) chemicals to dissolve or loosen asphaltene from the inner walls of the outer pipe 50; and (16) chemicals to dissolve or loosen scale from the inner walls of the outer pipe 50. Details regarding use of these fluids are discussed further below.

Selecting fluids for flow inside and outside the inner pipe 70 will depend on the type of the inner pipe 70 used as well as other design considerations depending on the application. For example, the fluid inside and outside the inner pipe 70 can be selected to be the same as the gross density of the walls of the inner pipe. While moving the inner pipe 70 axially within the outer pipe 50, the fluids may be continuously pumped through the inner pipe 70. As the fluid is pumped and the inner pipe 70 moves axially, the fluids in the annulus between the inner pipe 70 and the outer pipe 50 will comprise a mixture of the original fluids in the flowline 50 and the fluids pumped through the inner pipe 70. Eventually, all of the fluids in the annulus may be displaced by the fluid pumped through the inner pipe 70. Thus, it may be construed that the specific gravity of the fluids inside and outside the inner pipe 70 will end up the same.

The selected fluid may also be deliberately chosen to be two or more non-miscible fluids that separate under the influence of gravity into layers within the flowline 50 after exiting the inner pipe 70. By way of example only, the non-miscible fluid may comprise 50% of a fluid with an 8 pound per gallon (PPG) density and 50% of a fluid with a 12 PPG density such that the resulting fluid has a gross density of 10 PPG. This fluid taken together with the inner pipe 70 may have a resultant gross density of 12 PPG. When the fluid exits the inner pipe 70, approximately 50% of the fluid in flowline 50 will have a 12 PPG density. The 12 PPG fluid, under the action of gravity, will move to the lower parts of the flowline 50, provided that the annular flow is substantially laminar. The inner pipe 70 will thus be substantially neutrally buoyant in the 12 PPG fluid in the lower part of flowline 50. The non-miscible fluids may also have densities such that the inner pipe 70 remains neutrally buoyant in the entire fluid outside of inner pipe 70, instead of only being neutrally buoyant in only the heavier density fluid outside of inner pipe 70.

Referring now to FIG. 3, the jointed pipe 76 may be metal tubing or composite tubing made out of sections of rigid strength pipe that can be stacked and connected end to end for insertion into the flowline 50. The sections may be connected using pipe connections or welded. The jointed pipe 76 is welded or connected together as they are installed and the pipe itself would not be coiled. Jointed pipe 76 may also be segments or short lengths of composite pipe that are not reeled but which are connected together. One type of jointed composite pipe is described in U.S. Pat. No. 6,003,606.

Referring to FIG. 3, jointed pipe 76 may be inserted and installed inside flowline 50 using a snubbing unit 82 with snubbing techniques, well known in the art. Snubbing techniques are used when pipe 70 is not a continuous pipe but is a jointed pipe. Snubbing unit 82 engages a segment of the jointed pipe 76 and includes hydraulic pistons and cylinders to hydraulically force pipe 76 into the flowline 50. The pipe 76 is then released for another stroke. In between strokes, another segment of jointed pipe 76 is connected to the string of pipe 76 extending into flowline 50.

A much stronger inner pipe 70 can be used if snubbing is used to install it since snubbing can provide a much greater insertion force to force the pipe into the flowline 50 then can an injector for coiled tubing. Thus, snubbing allows the application of a greater force onto the string inner pipe 76 as it is forced into the flowline 50.

It can be appreciated that the jointed pipe 76 may be removed from flowline 50 also using snubbing techniques. Further snubbing techniques may be used to reciprocate the pipe 76 within the flowline 50.

Referring now to FIG. 2, inner pipe 70 is shown as coiled tubing 80. Coiled tubing is a substantially continuous tube. It should be appreciated that, depending upon the necessary length of the inner pipe 50, the coiled tubing 80 may include a plurality of lengths 84, 86 of coiled tubing 80 connected together by appropriate connectors 88. Individual lengths 84, 86 of coiled tubing 80 are disposed on a reel 94 for insertion and installation in flowline 50 as hereinafter described in further detail.

It is preferred that coiled tubing 80 be substantially neutrally buoyant in typical oil field well fluids. To achieve substantial neutral buoyancy, the parameters of coiled tubing 80 and of the fluids in the subsea tie back system may be designed to achieve a substantial neutral buoyancy. For example, composition and dimensions of the coiled tubing 80 itself may have a predetermined design such as the wall thickness of the tubing 80, the diameter of the tubing 80, and the density of the materials making up the coiled tubing 80. Further, the density of the fluids flowing within the flowbore 96 of inner coiled tubing 80 and the density of the fluids flowing in the flowbore 92 of flowline 50 and in the annulus 90 formed between the inner coiled tubing 80 and flowline 50 may also be varied. All of these parameters can be designed to achieve nearly or fully neutrally buoyancy. Further, the fluids passing through the inner coiled tubing 80 can be varied for the designed fluid to cause the inner coiled tubing 80 to react in a predictable manner as hereinafter described.

Of course the coiled tubing must have other properties other than near or full neutral buoyancy. These properties will vary with the particular installation. Thus, in choosing the material for the coiled tubing 80, such considerations will include pressure containment, tensile properties, chemical resistance, heat resistance, pressure differentials, and other properties required for the installation. The coiled tubing must also have the property of being able to resist the differential pressures between the interior and exterior of the inner pipe 70.

It should be appreciated that coiled tubing 80 may be metal coiled tubing, particularly if the metal coiled tubing may be made substantially neutrally buoyant. The inner pipe 70 of the present invention contemplates a pipe that can be constructed of any material having the necessary properties to make it substantially neutrally buoyant. The metal coiled tubing may be a type of composite by including a flotation material causing it to be a composite of multiple layers of different materials. For example, the metal coiled tubing could have a layer of floatation material disposed around it.

One of the advantages of metal coiled tubing is that it can withstand more heat than composite coiled tubing. It is preferred that the coiled tubing withstand any hot temperature of the well fluids because the well fluids are to be as hot as possible. Because heat is to be conducted through the coiled tubing into the well fluids, the fluids flowing through the inner pipe 70 will be as hot as possible.

Referring now to FIG. 2, a composite coiled tubing 80 is shown as the preferred embodiment of the inner pipe 70 of the present invention. Because composite coiled tubing meets the required characteristics, it is likely to be the material of choice. The inner pipe 70 is preferably a composite tube but may be any pipe or tube that may be made substantially neutrally buoyant. Further, composite coiled tubing is advantageous because it may be engineered for the particular mechanical properties required for the desired flow assurance operations at a particular installation. The coiled tubing can be engineered in many different ways that will depend upon the particular project. Composite coiled tubing has the advantage of being capable of being engineered for the particular installation. Not only can composite coiled tubing be engineered to be buoyant, but composite coiled tubing has other good properties, namely pressure containment, tensile properties, chemical resistance, heat resistance, pressure differentials, and other properties required for the particular installation. Thus, a composite tube is more advantageous than a metal tube. Composite coiled tubing is shown in U.S. Pat. Nos. 5,828,003; 5,908,049; 5,913,337; and 5,921,285 and European Patent Application No. 98308760.2 filed Oct. 10, 1998 published Apr. 28, 1999, Publication No. EP 0 911 483 A2, all hereby incorporated herein by reference. Lengths 84, 86 of composite coiled tubing 80 may be connected by connectors such as are shown in U.S. Pat. No. 5,988,702 and in U.S. patent application Ser. No. 09/534,685 filed Mar. 24, 2000 and entitled "Coiled Tubing Connector", both hereby incorporated herein by reference.

Figure 4:
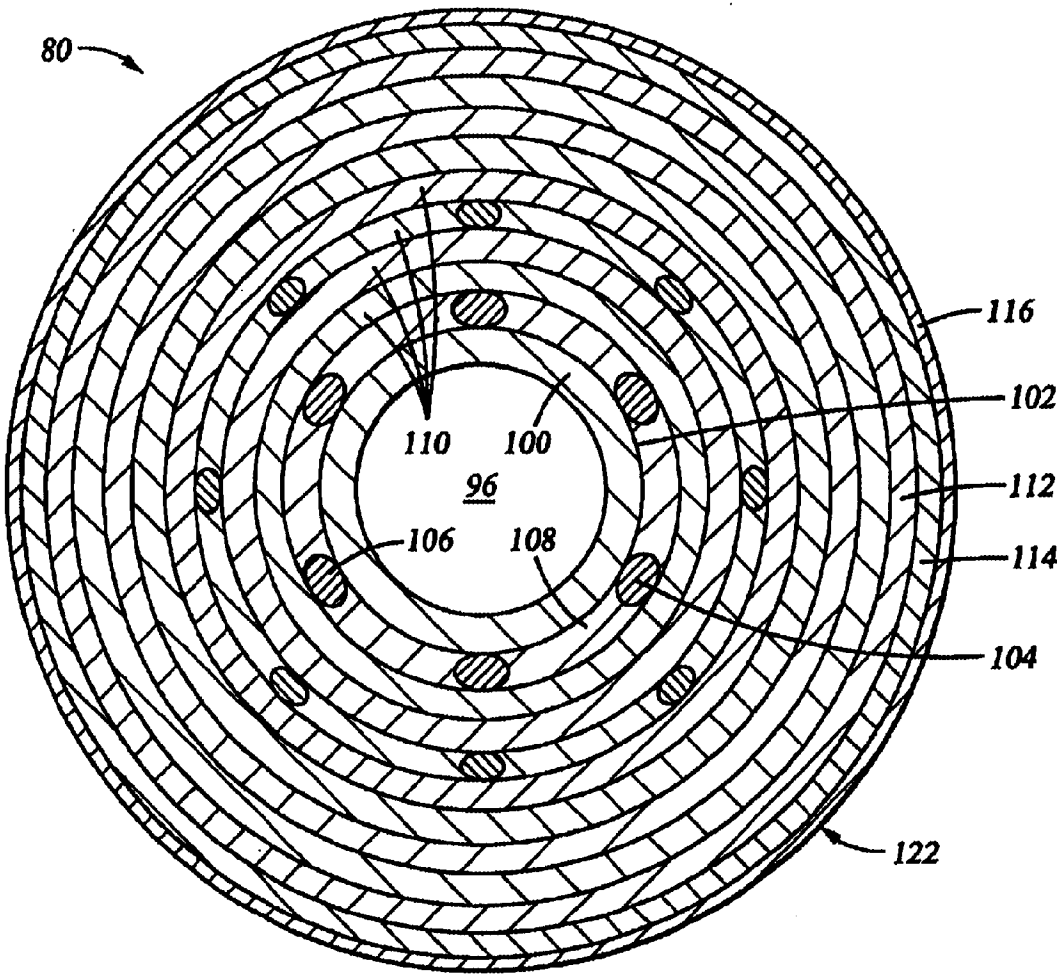
FIG. 4 is a cross-section of coiled tubing with conductors in the wall thereof where the coiled tubing is the continuous inner pipe of FIG. 2.

Referring now to FIG. 4, there is shown a most preferred composite coiled tubing 80 preferably including a tube made of a composite material and including an impermeable fluid liner 100, a layer of glass fiber 102, a plurality of conductors 104 and fiber optic cables 106 around the liner 100 and glass layer 102 embedded in a protective resin 108, a plurality of load carrying layers 110 forming a carbon fiber matrix, a wear layer 112, a layer of polyvinylidene fluoride (PVDF) 114, and an outer wear layer 116 formed of glass fibers. Impermeable fluid liner 100 is an inner tube preferably made of a polymer, such as polyvinyl chloride or polyethylene, or any other material which can withstand the chemicals used for flow assurance and the temperatures of any hot liquids flowing through flowbore 96. The inner liner 100 is impermeable to fluids and thereby isolates the load carrying layers 110 from the chemicals and/or hot liquids passing through the flow bore 96 of liner 100. The load carrying layers 110 are preferably a resin fiber having a sufficient number of layers to sustain the required load of the inner pipe 70, particularly during installation. The fibers of load carrying layers 110 are preferably wound into a thermal setting or curable resin. Load carrying fibers 110 provide the mechanical properties of the inner pipe 70. The wear layer 112 is preferably an outer load carrying layer 110. Although only one wear layer 116 is shown, there may be additional wear layers as required. The PVDF layer 114 is impermeable to well fluids and isolates the load carrying layers 110. The outermost wear layer 116 is preferably the outermost layer of fiber and is a sacrificial layer. Composite coiled tubing is also described in U.S. Pat. No. 6,296,066, issued Oct. 2, 2001 and entitled "Well System", hereby incorporated herein by reference.

Figure 5:
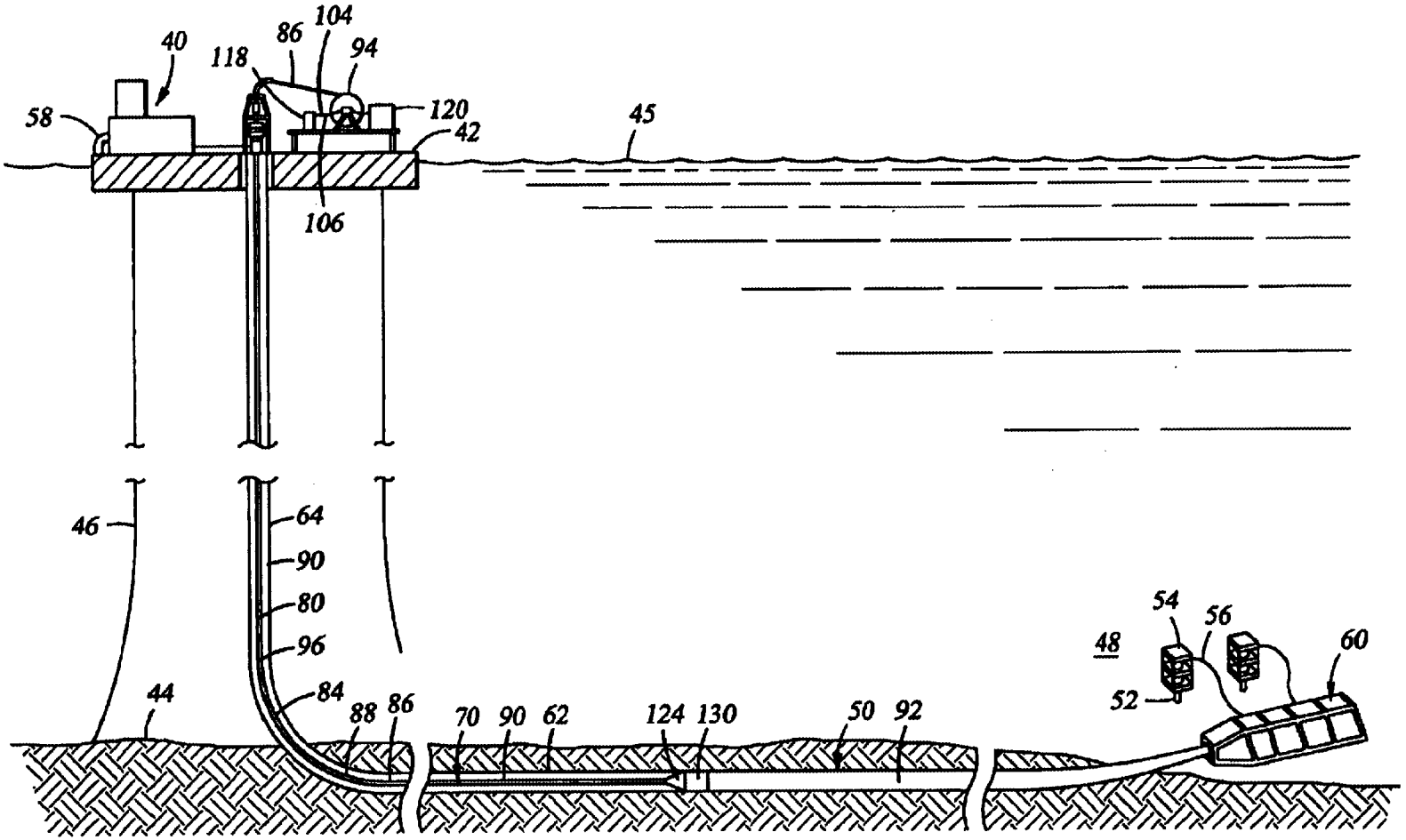
FIG. 5 is an elevational schematic, partly in cross-section, showing a subsea tie back of the present invention with a downhole tool mounted on the end of inner pipe.

Referring now to FIGS. 2, 4, and 5, the conductors 104 and fiber optic cables 106 that are housed within the composite tubing wall 122 extend along the entire length of composite coiled tubing 80 and are connected to a power supply 118 and to a surface processor 120. Their downhole ends may be connected to the electronics package 124 of a downhole tool 130, hereinafter described, for conducting a flow assurance operation within flowline 50. A standard communications fiber optics cable may be used. Conductors 104 may provide both power and command signals to the downhole tool 130. Further data collected by the downhole tool 130 may also be communicated "real time" through the conductors 104 and fiber optic cables 106 to the surface processor 120. It should be appreciated that conductors 104 and/or cables 106 in the wall of inner pipe 70 are merely an option and are not required for the present invention.

The fiber optics built into the wall 122 of the tubing 80 may be used to measure the temperature and pressure along the lengths 84, 86 of coiled tubing 80. For example, light reflectometry techniques may be used to monitor temperature along the full length of the inner pipe 70. A light is sent down the fiber optic cable 106 and an electronic device senses the reflection from the fired light to determine temperature at any point along the length of the coiled tubing 80. There are different types of light reflections and several different techniques for accomplishing the monitoring of temperatures using fiber optics. One method for the light reflectometry is to use Bragg gratings. The Bragg gratings act as spaced sensors. Other light reflectometry techniques allow for fully distributed measurements along the length of the fiber optic cable.

Light reflectometry may also be used to measure pressure. Light reflectometry can be used to measure strain. If the fiber optic cable 106 is wrapped helically around the liner 100 in the wall 122 of coiled tubing 80, as the pressure differential across the wall 122 of coiled tubing 80 causes the wall 122 to expand and contract, the fiber optics measure the strain caused by this pressure. The strain measurement is then related to pressure to achieve a pressure measurement.

The coiled tubing 80 may also include sensors embedded in the wall 122 of coiled tubing 80 which are spaced every few feet along its length for sensing temperature, pressure or other parameters. See U.S. Pat. No. 6,004,639, hereby incorporated herein by reference.

Although coiled tubing 80 is preferably composite coiled tubing with conductors and fiber optics along the length thereof, it should be appreciated that metal coiled tubing may also include conductors and fiber optics mounted on the interior or exterior of the metal coiled tubing.

Lengths 84, 86 of composite coiled tubing 80 with conductors 104 and cables 106 may be connected by the connector disclosed in U.S. patent application Ser. No. 09/534,685 filed Mar. 24, 2000 and entitled "Coiled Tubing Connector".

Referring now to FIG. 2, coiled tubing 80 may be inserted and installed inside flowline 70 using coiled tubing techniques. At the surface 45, an operational system 47 includes the power supply 118, the surface processor 120, and a powered coiled tubing spool or reel 94. The powered reel 94 feeds the coiled tubing 80 over a guide 124 and into an injector head unit 126. The injector head unit 20 feeds and directs coiled tubing 80 from the spool 94 through blowout preventers 128 and stuffing box 130 and into the flowline riser portion 64. The injection of coiled tubing 80 is a continuous operation as compared to the installation of jointed pipe. Although FIG. 2 illustrates installing coiled tubing 80 from platform 42, it should be appreciated that coiled tubing 80 may be injected into any point in the flowline 50 using standard coiled tubing installation techniques.

To reach very long distances (up to 100 miles), the coiled tubing 80 can be delivered on a plurality of different reels and then connected together by connectors, as previously described, as tubing 80 is run into the flowline 50.

Figure 6:
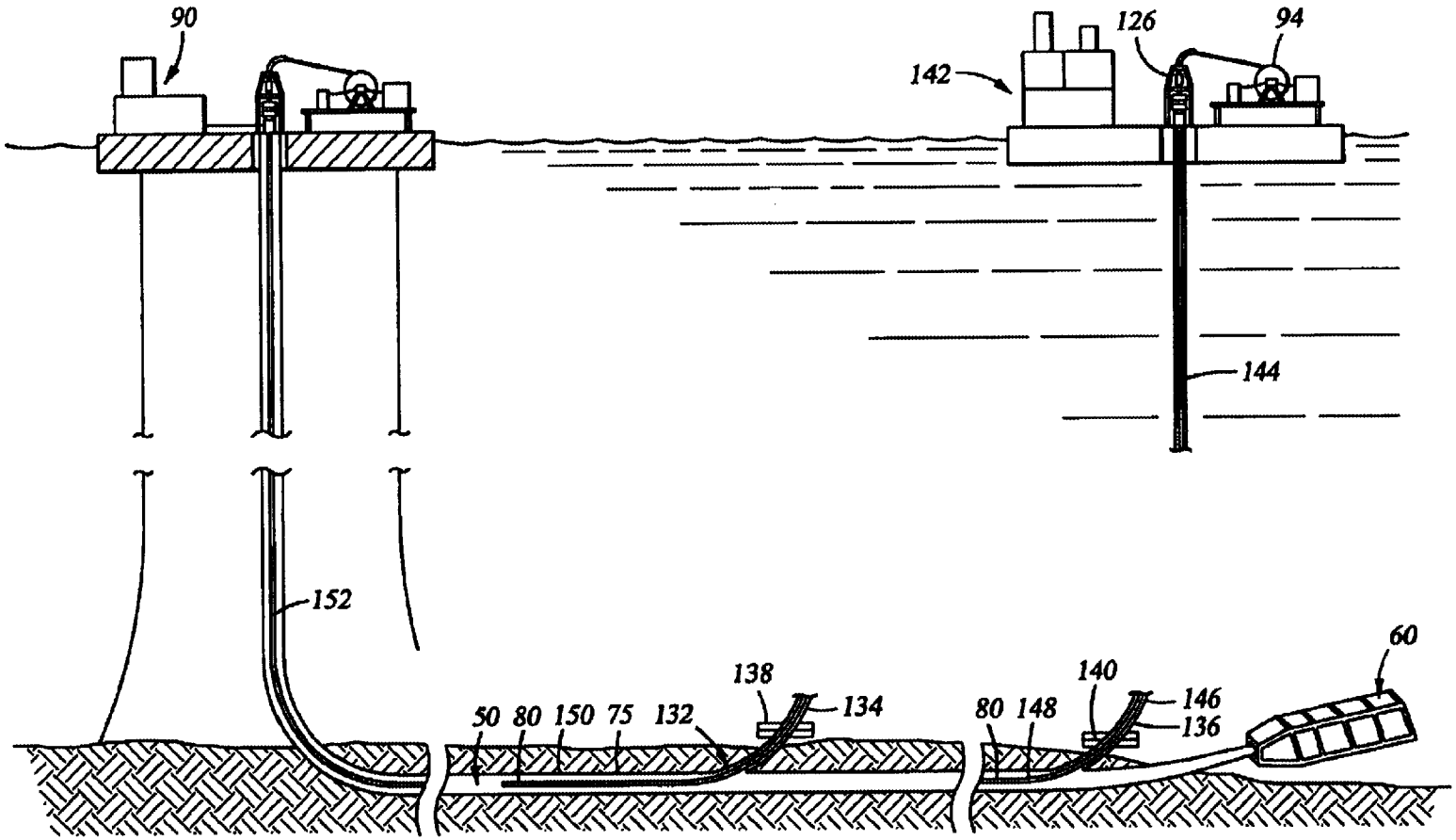
FIG. 6 is an elevational schematic, partly in cross-section, showing a subsea tie back of the present invention with a plurality of lengths of inner pipe disposed in the flowline.

Referring now to FIG. 6, installing coiled tubing 80 merely using injector head unit 126 will only allow coiled tubing 80 to be installed into flowline 50 a limited distance, particularly where the coiled tubing 80 is to be installed against the flow of well fluids. It is possible that fluid can be pumped through the flowline 50 and then the inner coiled tubing 80 inserted into the flow of the fluid allowing the fluid to carry the coiled tubing 80 through the flowline 50 to install the coiled tubing 80 within the flowline 50. The hydrodynamic forces may carry the inner coiled tubing 80 through the flowline 50 the distance required for flow assurance. An additional motive force may not be necessary. Such an installation method could not easily be used in a producing flowline unless there were a second flowline for circulation.

As shown in FIG. 6, coiled tubing 80 may be inserted and installed at any point along the flowline such as at manifold 60 or at a medial location 132 along the flowline 50. Connection points can be positioned in "siding" branches, such 134, 136, in the flowline 50 and manifold 60, respectively. Branches 134, 136 include "Y" shaped sections in flowline 50 and manifold 60 with branches 134, 136 having conduits for receiving the insertion and installation of coiled tubing 80 or a length of coiled tubing 80. Branches 134, 136 have gentle curves to receive and install coiled tubing 80 in flowline 50. These curves allow the insertion through branches 134, 136 of downhole tools, such as a tractor on the end of coiled tubing 80, as hereinafter described. Pressure control equipment 138, 140 is included on branches 134, 136 together with valving not shown. The entry point includes various components that one might find in a wellhead. For example, one type of pressure control equipment might look like a lubricator.

The flowline 50 may need to be picked up from the sea bed 44 to insert the inner pipe 70 because it may not be possible or practical to access the flowlines in any other way. For example, the flowline 50 may be buried in the sea bed 44.

Branch 136 at the manifold 60 is preferred because it provides flexibility in using coiled tubing 80 for flow assurance. As hereinafter described in further detail, the outboard conduit 146 of branch 136 may allow the liquid flowing through coiled tubing 80 to empty into the sea or branch 136 may be connected to another flowline or return line to the production facility 40. Further, coiled tubing 80 may remain connected to branch 136 or be disconnected. Branch 136 also allows multiple inner pipes 70, 71.

Coiled tubing 80 may be inserted and installed through branches 134, 136 in flowline 50 and manifold 60 using coiled tubing techniques from a floating vessel 142 also having a powered reel 94 feeding coiled tubing 80 into an injector head unit 126 using a Swift Riser 144. The Swift Riser 144 is used to deploy coiled tubing 80 from the floating vessel 142. The Swift Riser includes a method deploying a coiled tube or composite tube where the vessel holds the reel of coiled tubing 80 and then pushes the tubing 80 into the flowline 50 from the vessel.

Although the coiled tubing 80 may be inserted either with the flow of well fluids or against the flow of well fluids, as shown in FIG. 6, it is preferred to insert the coiled tubing 80 with the flow of the well fluids in flowline 50 whereby the hydrodynamics of the flow of well fluids assists the insertion and travel of the coiled tubing 80 within flowline 50. It is advantageous to install the inner pipe 70 without having to interrupt the flow through the flowline 50.

Figure 9:
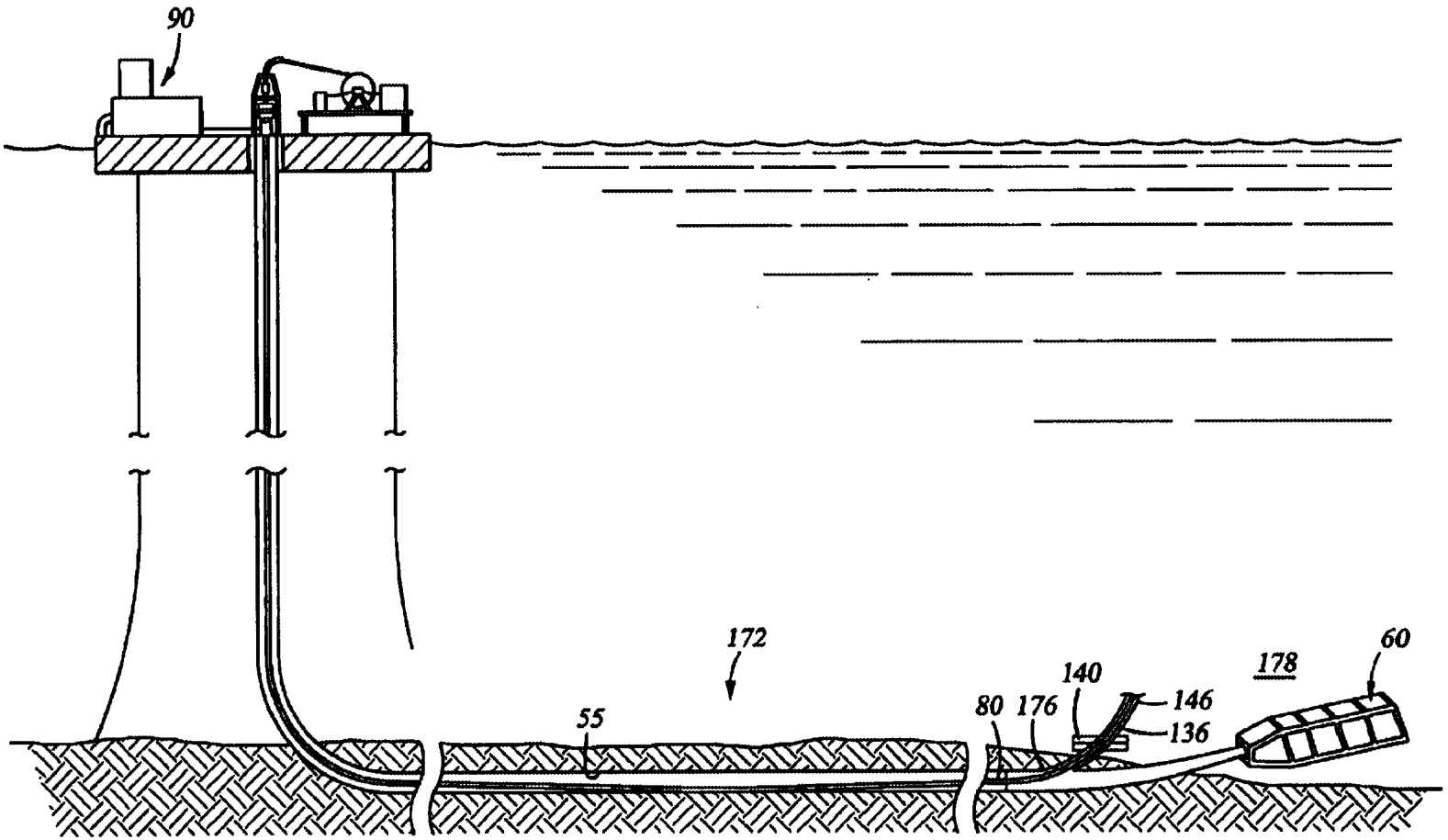
FIG. 9 is an elevational schematic, partly in cross-section, showing a environmental closed subsea tie back of the present invention.
Figure 10:
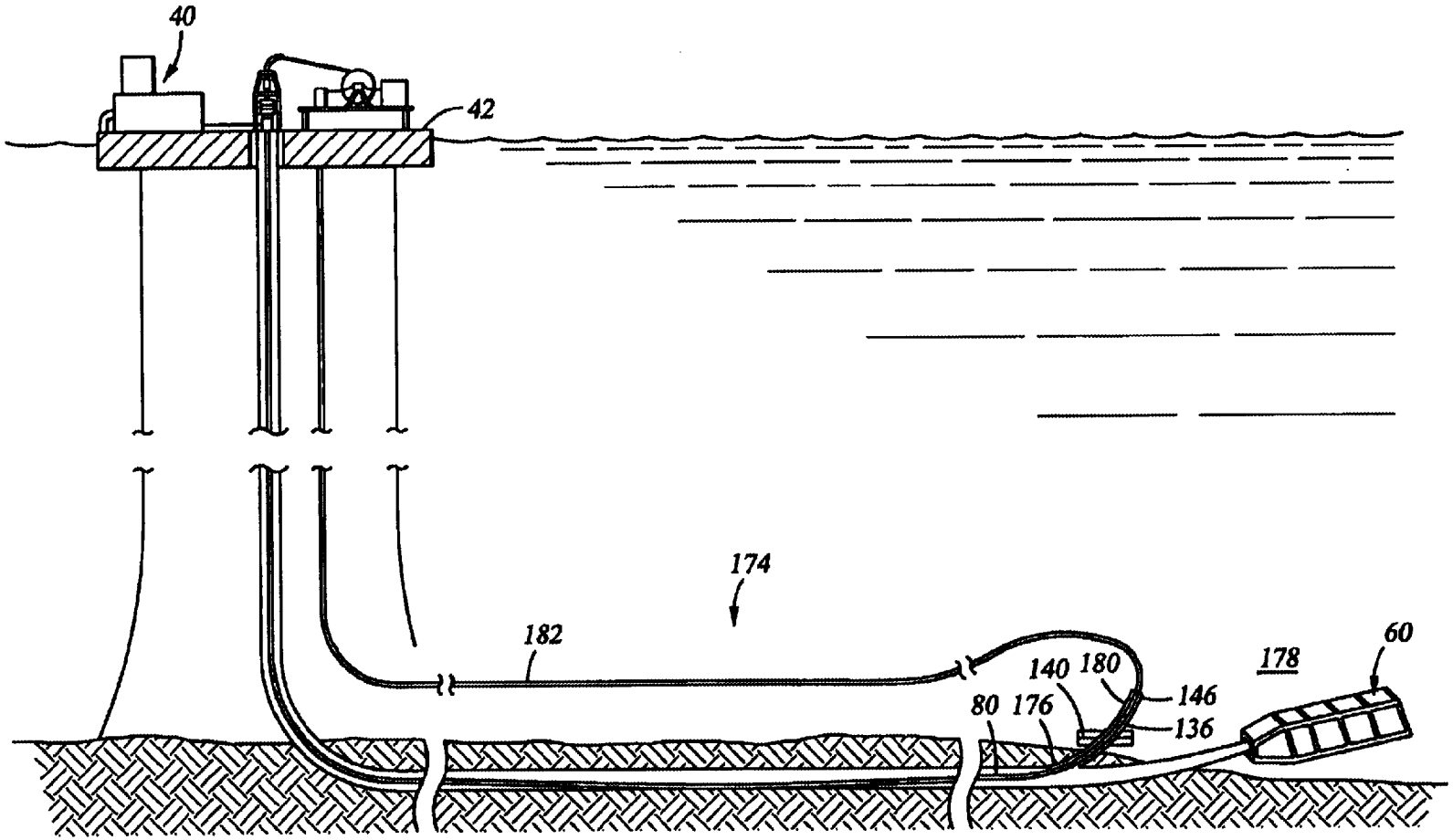
FIG. 10 is an elevational schematic, partly in cross-section, showing a return closed subsea tie back of the present invention.
Figure 11:
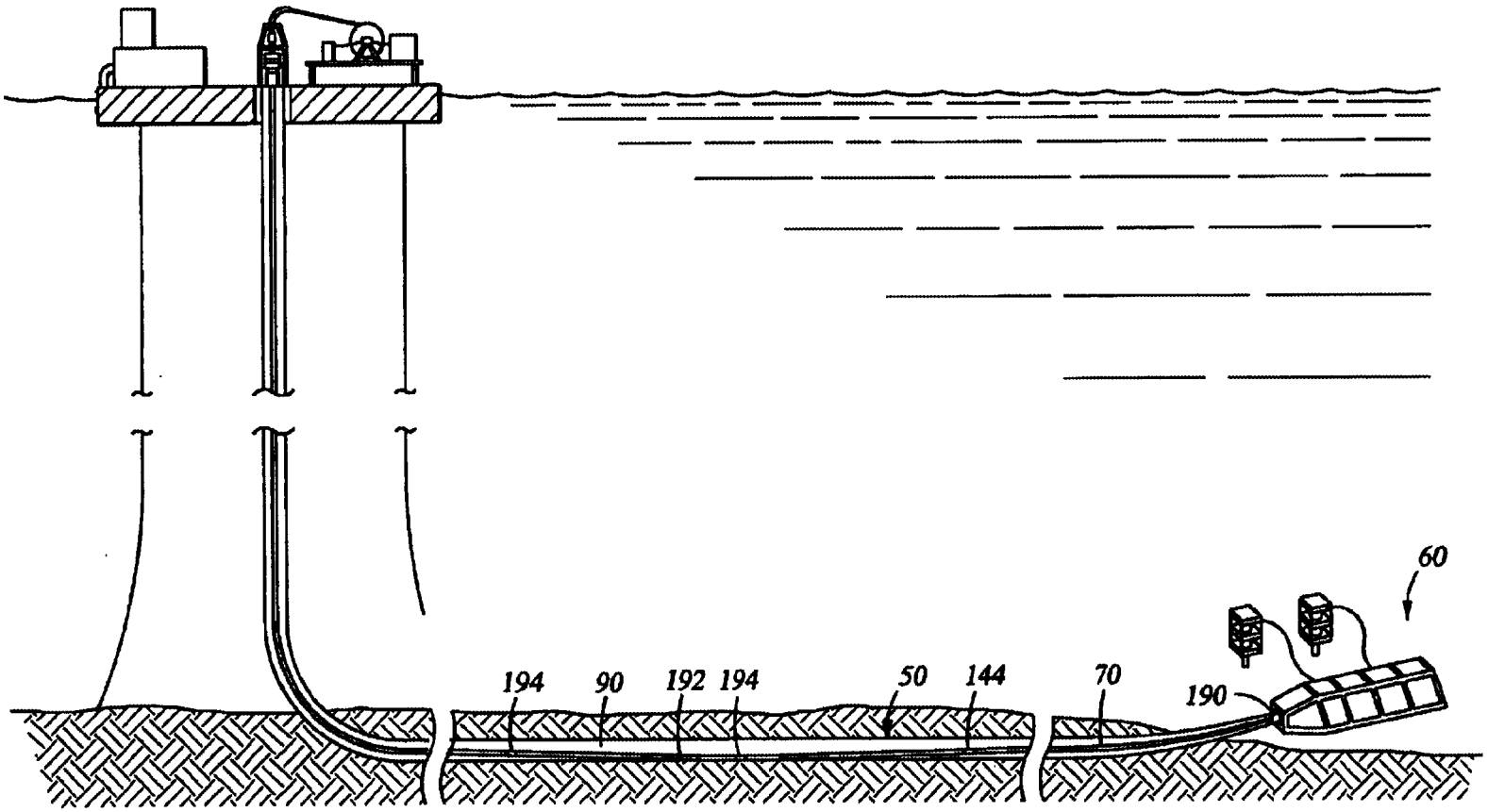
FIG. 11 is an elevational schematic, partly in cross-section, showing a subsea tie back of the present invention with the inner pipe having valving and anchored to the manifold or at any point along the flowline.

Allowing the inner pipe 70 to be inserted into the flowline 50 at any point provides many advantages. If the flowline 50 is blocked and the inner pipe 70 is to be used to clear the blockage, this method allows the inner pipe 70 to be installed near the blockage, wherever the blockage is located in the flowline 50, which may be many miles long. Further as previously described, if the subsea tie back is to be a hundred miles long, the inner pipe 70 may be installed in segments, such as segments 148, 150, 152 shown in FIG. 6. If there was a 100 mile flowline and suppose that the inner pipe 70 can only be installed in segments twenty miles long, the 20 mile segments of inner pipe 70 would be installed at various points along the flowline 50. Typically this would be a temporary installation that would not require the connection of the multiple segments 148, 150, 152 of inner pipe 70. However, if it was going to be a permanent installation of the inner pipe 70 within the 100 mile flowline 50, the adjacent ends of the inner pipe 70 would be connected together at the entry points to form a continuous inner pipe 70 from production facility 40 to manifold 60 as shown in FIGS. 9–11. The flowline 50 could include five entry points for the installation of the 5 twenty mile segments of inner pipe 70.

To install coiled tubing 80 any appreciable distance within flowline 50, as for example several miles, it is preferable to provide a motive means. For example, either a pig or a propulsion system may be attached to coiled tubing 80 to provide a motive force for installation. The lower end 135 of the coiled tubing 80 may be connected to the pig or tractor by a disconnect assembly for connecting and disconnecting the coiled tubing 80. Further, the inner pipe 70 must have the necessary tensile strength to withstand the necessary pull on the composite coiled tubing 80 by any motive means.

One method of assisting the installation of the inner pipe 70 within flowline 50 is to pump fluid through the annulus 90 formed between the inner pipe 70 and outer flowline 50. This is particularly applicable to a new installation where a pump can be connected to the flowline 50. The fluids can then be pumped in the same direction as the direction of insertion of the inner pipe 70 so that the pipe 70 is moving in the same direction as the fluids. Such moving fluid may allow installation without a tractor or pig, for example. In a new installation, the inner pipe 70 may be installed before well fluids are flowing through the flowline 70.

By the inner pipe 70 being substantially neutrally buoyant, any friction otherwise caused by the weight of the inner pipe 70 acting against the inner surface 55 of the outer flowline 50 is eliminated. Thus, the friction no longer limits the distance that the inner pipe 70 can be inserted into the outer flowline 50. However, there are still secondary effects on the inner pipe 70 that will ultimately limit the distance that it can be installed within the flowline 50. Any flowline 50 is going to extend across an undulating terrain having curves both up and down and sideways due to the terrain of the sea floor 44 being uneven. It is necessary that the inner pipe 70 negotiate all the curves in the flowline 50. Thus, the inner pipe 70 will tend to engage the walls of the flowline 50, particularly around the curves and bends in the flowline 50, and thus create capstan friction. Capstan friction occurs when any member moves against another member as it moves around a bend. Therefore, because of the bends in the flowline 50, there will be capstan friction between the inner pipe 70 and the wall 55 of the flowline 50.

Also as previously described, there may be hydrodynamic resistance from the well fluids if the well fluids are flowing against the inner pipe 70 as it is passed through the flowline 50. The hydrodynamic influence will slow the speed of moving the inner pipe 70 through the flowline 50.

Figure 7:
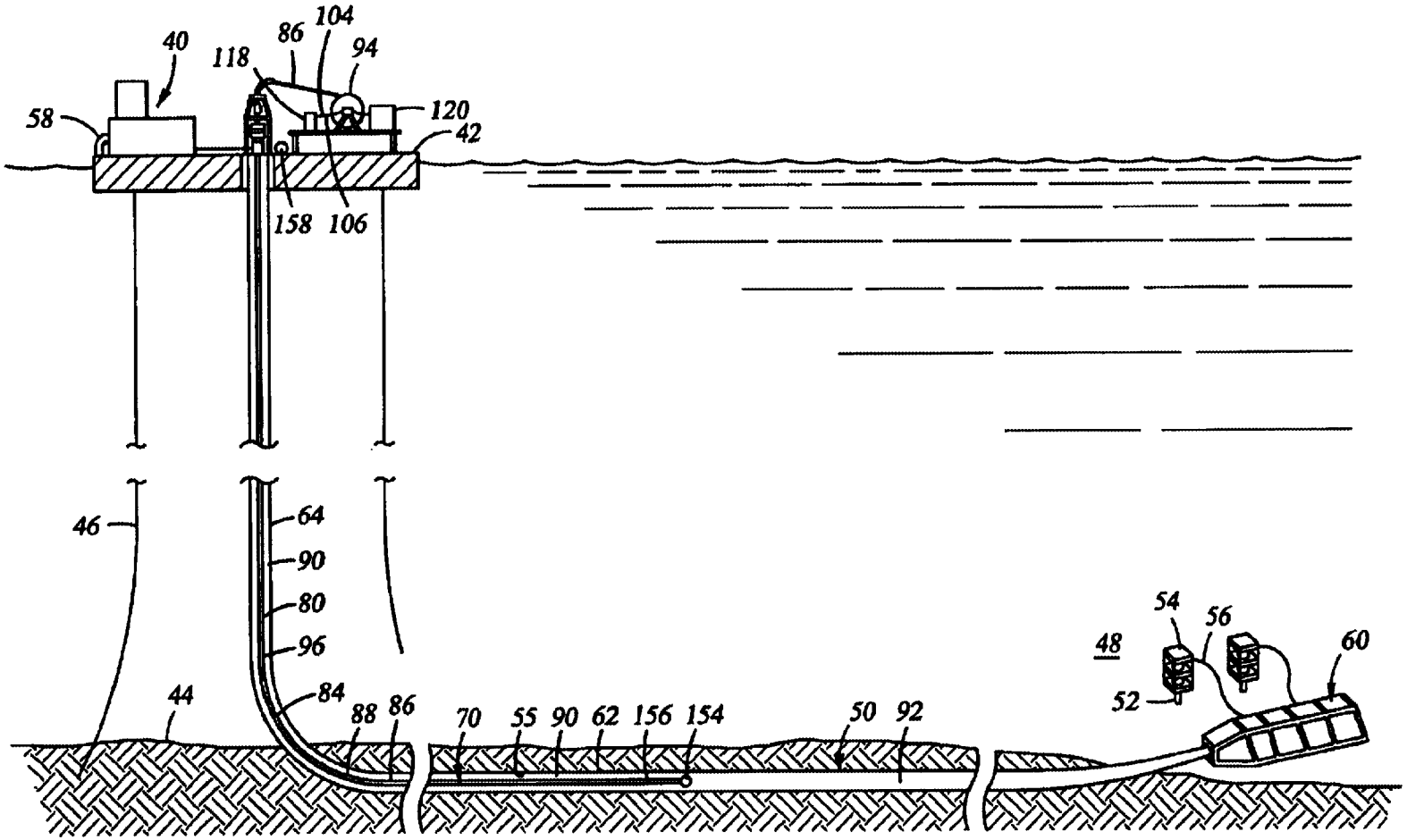
FIG. 7 is an elevational schematic, partly in cross-section, showing a subsea tie back of the present invention with a pig attached to the end of the inner pipe.

Referring now to FIG. 7, one method for installing the inner pipe 70 in view of these secondary effects is to attach a flow restriction member, such as a pig 154, to the end 156 of the coiled tubing 80. Fluid is pumped by a pump 158 on platform 42 through the annulus 90 between inner pipe 70 and flowline 50. The fluid flow against pig 154 provides the motive force to propel coiled tubing 80 within flowline 50 by creating a pressure differential across the pig 154. The inner pipe 70 with pig 154 is thus pumped down the flowline 50. The pig 154 does not necessarily located at the end 156 of the coiled tubing 80. Further, it is also not necessary to have only one pig and there may be a plurality pigs attached along the length of inner pipe 70.

Figure 8:
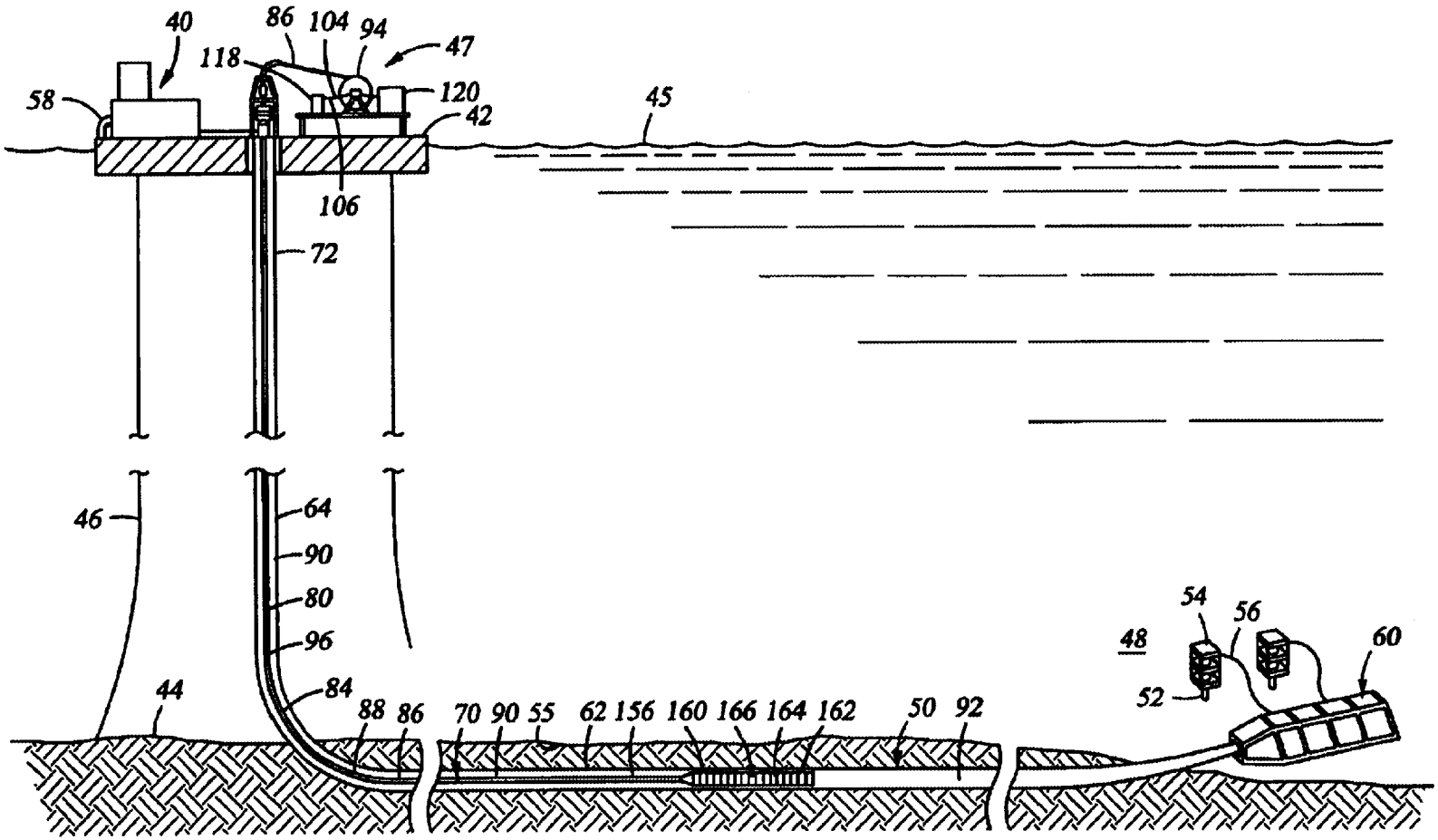
FIG. 8 is an elevational schematic, partly in cross-section, showing a subsea tie back of the present invention with a propulsion member connected to the end of the inner pipe.

Referring now to FIG. 8, a propulsion system, such as a tractor 160, may be connected to the end 156 of coiled tubing 80 to provide the motive force for inserting and installing the coiled tubing 80 within flowline 50. If the coiled tubing 80 is at or near neutrally buoyant in the fluid of the flowline 50, the tractor 160 may pull the coiled tubing many miles, possibly up to 100 miles, through the flowline 50.

A tractor will have to work against much higher forces if it is installing the inner pipe 70 in a direction against the flow of the well fluids in the flowline 50. Thus, whether the inner pipe 70 can be installed in a direction against flow will depend upon the amount of motive force that can be achieved by the tractor 160.

One of the issues is the radius of the different bends in the flowline 50 because if the radius of curvature of the bend is too small, it may not accommodate the use of a tractor. Any curve will provide some friction and resistance to moving the inner pipe 70 within the flowline 50. Thus, it is important that the entry point have a very "kind" curve for the insertion of the tractor 160 and tubing 80. The entry point will include valves and pressure control equipment as previously described. In inserting the inner pipe 70 into the flowline 50 through branches 132, 134, the curved conduits of branches 132, 134 into the flowline 70 have a gentle curvature to receive the end 135 of inner pipe 70 with tractor 160.

Various types of tractors may be used such as the Western Well Tool tractor shown in U.S. Pat. No. 6,003,606 or the propulsion system shown in U.S. Pat. No. 3,180,437, both hereby incorporated herein by reference. Welltec also manufactures both an electric and a hydraulic powered tractor. These propulsion systems may be powered either hydraulically or electrically.

A tractor powered electrically may be used if the coiled tubing 80 of FIG. 4 were used as the inner pipe 70 because that coiled tubing includes conductors 104 that transmit electrical power downhole from platform 42. Sufficient power would be provided for the tractor to work against any counter flow of well fluids.

The Western Well Tool tractor uses fluids flowing through the coiled tubing 80 to provide power to the tractor 160.

The Welltec hydraulic powered tractor includes a turbine with vanes that are rotated by the passage of liquids through the turbine. The liquid having momentum contacts the vanes and then changes direction. This change of direction provides a force against the vanes to rotate the turbine. The liquid drives the turbine and the turbine is connected to a hydraulic pump in the tractor. The hydraulic pump is part of a closed hydraulic system in the tractor with the closed circuit keeping the hydraulic fluid in the system clean. The Welltec tractor drives wheels on the tractor that engage the flowline wall 55. Each wheel has a hydraulic motor.

Where the tractor 160 is hydraulically powered from the fluids passing through the inner pipe 70, once the tractor 160 has pulled the inner pipe 70 several miles, the hydraulic pressure of the fluids flowing through several miles of inner pipe 70 will dissipate over that long distance as it reaches the tractor 160. The liquid can be pumped through the inner pipe 70 but it will not provide enough energy at the tail end as it passes through the tractor 160 to power the hydraulically powered tractor. Thus, the energy needed to operate the tractor 160 may not be sufficient by the time it reaches the tractor 160. Hydraulically powered tractors require a minimum amount of hydraulic pressure.

One solution is to insert a slug of gas from time to time into the flowbore 96 of inner pipe 70. Gas does not have the same loss of energy as a liquid and can transmit pressure for very long distances, especially at relatively low flow rates. The liquid loses its energy due to friction losses and the gas does not have the same extent of friction losses. Compressed gas can transmit a lot more energy than liquid. Because gas is so compressible, it has a huge amount of energy stored in the gas and thus is a good energy transmission vehicle. This high pressure is therefore able to be transmitted right up to the interface between the gas and the power liquid. However, it cannot transfer sufficient energy or momentum to the type of turbine typically used in these tractors.

For example, if the inner pipe 70 were completely filled with gas, a 5,000 psi pressure gas at the inlet of the inner pipe 70 would transfer almost the entire 5,000 psi pressure to the tractor 160 several miles away. At the gas/liquid interface, the gas, having a 5,000 psi of pressure, applies a 5,000 psi pressure on the liquid at the gas/liquid interface. Thus, the gas is used to drive the liquid. Slugs of gas and segments of liquid will alternately be flowed through inner pipe 70.

The gas/liquid interface may incorporate a gel in order to keep the phases separate. This layer of gel in between the gas and liquid prevents the gas from traveling over the top and around the liquid where instead of transferring the force to the liquid, the gas attempts to pass around the liquid.

As the power fluid flows through the inner pipe 70, the liquid/gas interface also moves, i.e., meaning that the high-pressure region also moves, such that the distance between the tractor 160 and the high-pressure region gets shorter. The net effect is that the power fluid has a progressively shorter distance to travel between the high-pressure region and the tractor 160 so that there is less pressure drop between the high-pressure region and the tractor 160. In this way the tractor 160 will be able to receive sufficient power to pull the inner pipe 70 into the flowline 50.

Eventually the interface between the gas and the power fluid will reach the tractor 160. Once the gas has reached the tractor 160, the tractor turbine will not be able to generate enough power since the gas has a significantly lower density than the power liquid. The tractor 160 will stop. However the gas will be followed by another tranche of power fluid which itself will also be driven by pressurized gas. Once the power liquid reaches the tractor turbine, and as it passes through it, the tractor 160 will move and pull the inner pipe 70. The gas and power liquid is sequenced in amounts suitable to the design of the tractor turbine and the hydraulic properties of the fluids and inner pipe 70. The inner pipe 70 will thus enter the flowline 50 in spurts. Insertion distances of up to 100 miles are possible using this technique in conjunction with a tractor driven by a hydraulic turbine.

Because the liquid and gas passing through the flowbore 96 of the inner pipe 70 ultimately exits the tractor 160 into the annulus 90 between the inner pipe 70 and outer flowline 50, the introduction of the gas into the annulus 90 will benefit the buoyancy of the inner pipe 70 within the flowline 50. The design of the inner pipe 70 will account for the reduction of buoyancy due to the gas so as to still have sufficient buoyancy to install the inner pipe 70. However, assume a 1½ inch inner pipe 70 inserted into a 12 inch diameter flowline 50. Those cross-sections require more than 60 times more time to fill any given length of the annulus 90 in the flowline than to fill the inner pipe 70. For instance, given a five-mile long flowline and typical flowrates, it would take eight hours to fill the annulus 90 in the flowline 50 and only eight minutes to fill the flowbore 96 of inner pipe 70. Because there is a big difference in these volumes, the gas passing through the smaller inner pipe 70 will not have a great impact on the density of the well fluids in the annulus 90. Also, fluids that are selected to operate the tractor 160 may include liquids such as the drilling fluid, which has a high density, and a gas, such as nitrogen.

Alternatively, a gas and a liquid may be combined with a foaming agent to create a foam as the power fluid to power the tractor 160. For example, water can be mixed with nitrogen. The foaming agent may also be selected to have a predetermined useful life. The useful life may be designed such that the foam is stable while be pumped through the inner pipe 70. Upon exiting the inner pipe 70, the foam then destabilizes and separates back into liquid and gas. The inner pipe 70 taken together with the foam may be selected with a total gross density such that the inner pipe 70 remains substantially or fully neutrally buoyant in the separated liquid that will be disposed at the lower parts of the flowline under the influence of gravity.

It should be appreciated that the inner pipe 70 can be removed from the flowline 50 using the same coiled tubing techniques.

In a new installation, the inner pipe 70 is preferably installed when there is no fluid flow through the flowline 50, although there is no reason why the inner pipe 70 cannot be installed in the flowline 50 while there is fluid flowing through the flowline. One can enter a pressurized flowline. It is simply a matter of having the proper pressure control equipment installed such as coiled tubing blowout preventers. Of course there will be hydrodynamic forces acting on the inner pipe 70 as it is installed while well fluids are flowing through the flowline 50. This would require a tractor 160 on the end of the inner pipe 70 to work against higher forces where the inner pipe 70 is being installed against flow.

In existing flowlines 50, only a sufficient bend radius is required to allow pigs to pass through the flowline. The minimum bend radius for pigs is five times the diameter of the flowline 50, i.e., a 5D bend. That is the classic minimum radius of flowlines. Thus, the inner pipe 70 will have to negotiate these tight 5D bends within the flowline 50. Any tractor 160 put on the end 135 of the inner pipe 70 to install it within the flowline 50 must negotiate the 5D bends in the flowline 50.

In the above case the tractor assembly 160 at the end 135 of inner pipe 70 may be constructed such that it is able to negotiate the 5D bends. For the tractor 160 to negotiate 5D bends, the housing 162 may be made up of segments 164 connected together by a type of universal joint 166 so that the housing 162 will bend with the bends and curves in the flowline 50.

The inner pipe 70 can be installed inside the flowline 50 after the flowline 50 has been installed on the seabed 44. In installing the inner pipe 70 after the flowline 50 has been installed, the substantial neutral buoyancy of the inner pipe 70 will minimize the force required to install the inner pipe 70 within the flowline 50. The motive force will be a tractor 160, a pig 154, or simply the hydrodynamic forces of a flowing fluid in the annular space 90.

It should be appreciated that in a permanent installation, the inner pipe 70 may be installed simultaneously with the outer flowline 50. It is possible to install the inner pipe 70 with the flowline 50. Unfortunately the cost of connecting the sections of inner pipe 70 and outer flowline 50 is very expensive and is prohibitively expensive in large diameter pipe. There are now vessels that can reel 16 inch diameter pipe. Thus, the dual concentric pipe could be built on shore by welding the adjacent inner pipe sections together while at the same time welding the outer flowline sections together and then reeling the assembled dual concentric pipe onto the vessel's reel. The dual concentric pipe might possibly also be towed to location and then installed. It should be appreciated that it is more practical to install the inner pipe after the flowline has been installed.

Referring now to FIG. 11, if the inner pipe 70 is to remain in place in a fluid that is flowing in a direction opposite to the insertion direction of the inner pipe 70, it is preferred to anchor the upstream end of the inner pipe 70. An anchor 190 may be disposed on end 135 of pipe 70 to anchor the inner pipe 70 relative to the flowline 50 in order to resist hydrodynamic forces from the flow in the flowline 50. The flow of fluids around the inner pipe 70 within the outer flowline 50 will have an effect on the inner pipe 70. There may be an adverse behavior, such as vibration or buckling, of the inner pipe 70 as the well fluids are flowing by it due to the hydrodynamics. Once the inner pipe has been anchored, the inner pipe 70 can then be tensioned inside the flowline 50 by pulling against the anchor 190. These adverse conditions can be controlled by varying the tension on the inner pipe 70. Control on the tension assists in controlling the behavior of the inner pipe 70 and the flowing fluid around it. It may be an advantage for the inner pipe 70 to lay on one side of the outer flowline 50 because the inner pipe 70 will then have a better reactive behavior when the fluid flows around the inner pipe 70.

It is preferred that the upstream end 135 of the inner pipe 70 be anchored and the downstream end extend through the entire flowline 50 and through the injector head unit 126 on the platform 42. If the inner pipe 70 extends the full length of the flowline 50, the upstream end 135 of the inner pipe 70 will be anchored at or near the manifold 60. Anchoring the upstream end 135 is preferred because if it is not anchored, the well fluid flow will tend to push the inner pipe 70 out of the flowline 50.

There are various types of anchoring devices. One type of anchor 190 may be attached to the end of the inner pipe 70 and then connected at or near the manifold 60. The anchor 190 may merely be a latch between the end of the inner pipe 70 and flowline 50 or manifold 60 as for example a spring loaded latch. One scenario is where there is a latching member already installed near the manifold 60 to which the end of the inner pipe 70 will latch into, such as a collet type connection. The flowline 50 or manifold 60 may have a connection similar to a packer with the inner pipe 70 latching into the packer. Further, the flowline 50 may include a connecting member disposed therein that is prepared to receive and latch onto the end of the inner pipe 70. The anchor 190 may be remotely releasable by mechanical (e.g. shear pin), electrical (e.g. solenoid operated pin), hydraulic (pressure pulse activated), or other suitable release device.

In the case where the inner pipe 70 is a retro-fit into a flowline 50 and there is nothing to latch into, the anchor 190 may be carried on the end of the inner pipe 70. Such an anchor may be a member disposed on the end of inner pipe 70 that is actuated to frictionally engage the inner surface 55 of the flowline 50. This type anchor allows the inner pipe 70 to be anchored to the inner surface 55 of flowline 50 at any point along the flowline 50. For example, a friction coupling with the flowline 50 could be used. There can also be serrated slips that are actuated to bitingly engage the interior surface 55 of the flowline 50. Any of the packer feet used on the tractors may also be used as retention devices. See for example the borehole retention device described in U.S., patent application Ser. No. 09/485,473 filed Apr. 30, 2001 and entitled "Borehole Retention Device".

The anchor 190 may be a flexible packer or pre-installed packer attached to the end 135 of the inner pipe 70 or a pre-installed packer with the end 135 of inner pipe 70 snubbed into the pre-installed packer in just the same way that downhole completions are carried out. The packer is then actuated so as to close off the annulus 92 and allow well fluids to flow through the inner pipe 70.

The annulus may then be filled with an insulating medium that can be pumped into place to insulate the inner pipe 70. An insulating means could be a flowing fluid or it could be a static fluid in the annulus 90. It could be cement. It should be appreciated that there can be a plurality of inner pipes 70, 71 within the flowline 50 lying parallel to each other in the flowline 50. Although this embodiment loses flexibility, it does assist with the problem of turn down as hereinafter described in further detail. This embodiment is still more advantageous than a 10 inch flowline being inserted into a 16 or 18 inch outer pipe with insulation in the annulus therebetween. Obviously a 16 or 18 inch outer pipe will require additional insulation making it much more expensive.

The inner pipe 70 of the present invention may be used in many operations and methods related to flow assurance. Flow assurance management will differ depending upon which variation is used. The following describe some of the flow designs for use with the inner pipe 70.

Referring again to FIG. 2, the inner pipe 70 may be used in an open circuit 170. In the open circuit 170, the upstream end 135 of inner pipe 70 is open such that any fluids being pumped through inner pipe 70 will flow into the flowbore 92 of flowline 50. The fluids exiting inner pipe 70 will mix with the fluids in the flowline 50 and commingle with the well fluids traveling upstream. The open circuit 170 is typically used to mix fluids with the well fluids in the flowline 50 to condition the well fluids.

If the open circuit 170 is used, then the fluids that flow through the inner pipe 70 to commingle with the well fluids must ensure that the commingling of the fluid with the well fluids does not pose a problem with the well fluids. For example, it may not be suitable for water to be commingled with well fluids because of the hydrate problem. One preferred fluid would be stabilized crude, i.e., well fluids that have been processed at the production facility 40. The processed crude is heated and recirculated through the inner pipe 70 and back up the annulus 90 between the inner pipe 70 and flowline 50.

Referring now to FIG. 9, the inner pipe 70 may be used in an environmentally closed circuit 172. In the closed circuit 172, there is a docking component with an outlet at the mandrel 60 for attaching and docking the upstream end 135 of the inner pipe 70. In the closed circuit 172, hot sea water is flowed through the inner pipe 70 and out an outlet, such as branch 136, into the open environment or sea water because the fluid flowing through the inner pipe 70 is sea water anyway. This is a variation to the open circuit 170 in that the inner pipe 70 is not open to the flowline 50 but it is open to the sea water environment.

In the closed circuit 172, the end 135 of inner pipe 70 is connected to a connection 176 that is a pre-installed internal connection point for inner pipe 70 at the far end of the flowline 50. The connection point 176 may be connected to the anchor 190. The connection point and the anchor point can be combined. Once the inner pipe 70 has been installed into the flowline 50 and connected to the connection point 176, this connection point directs the fluid leaving the upstream end 135 of the inner pipe 70 and includes a conduit 180 from the end 135 of the inner pipe 70 to another conduit that directs the fluids from the inner pipe 70 to a place outside the flowline 50. The conduit can be provided with a valve. Connection 176 is preferably a releasable connection.

Connection point 176 may be "Y" branch 136 communicating outside flowline 50, such that the fluids pumped through the inner pipe 70 do not mix with the fluids in the flowline 50. In the system shown in FIG. 9, the "Y" branch 136 opens into the open sea. Thus, any fluids flowing through inner pipe 70 in the environmental closed circuit 172 flow into the sea.

In some cases it may be desirable to have a closed circuit 172 where the flow in the inner pipe 70 does not mingle with the flow in the flowline 50. The environmental closed circuit 172 allows hot liquids compatible with the sea water to be pumped through the inner pipe 70 and dumped into the sea. In the preferred embodiment, heated sea water is pumped through the inner pipe 70 and then out into the open sea water. However, the inner pipe 70 is closed as far as the well fluids are concerned. The fluid through the inner pipe 70 can either flow into the sea or flow into another fluid line returning to the production facility.

Referring now to FIG. 10, the inner pipe 70 may be used in an return closed circuit 174. In the return closed circuit 174, the end 135 of inner pipe 70 is connected to a connection 176. However, the conduit 180 from the connection 176 is connected to a return line 182 that extends back to the platform 42.

The return closed circuit 174 is particularly useful where the fluid passing through the inner pipe 70 is not sea water and is a fluid that can not be dumped into the sea water environment 178. Instead of dumping the fluid into the sea water environment, it passes to a return pipe returning the fluid to the production facility 40. For example, heating fluids can be continuously circulated in the return closed circuit system 174 and returned to originating point of the pumped heating fluids such as the production facility 40.

Figure 16:
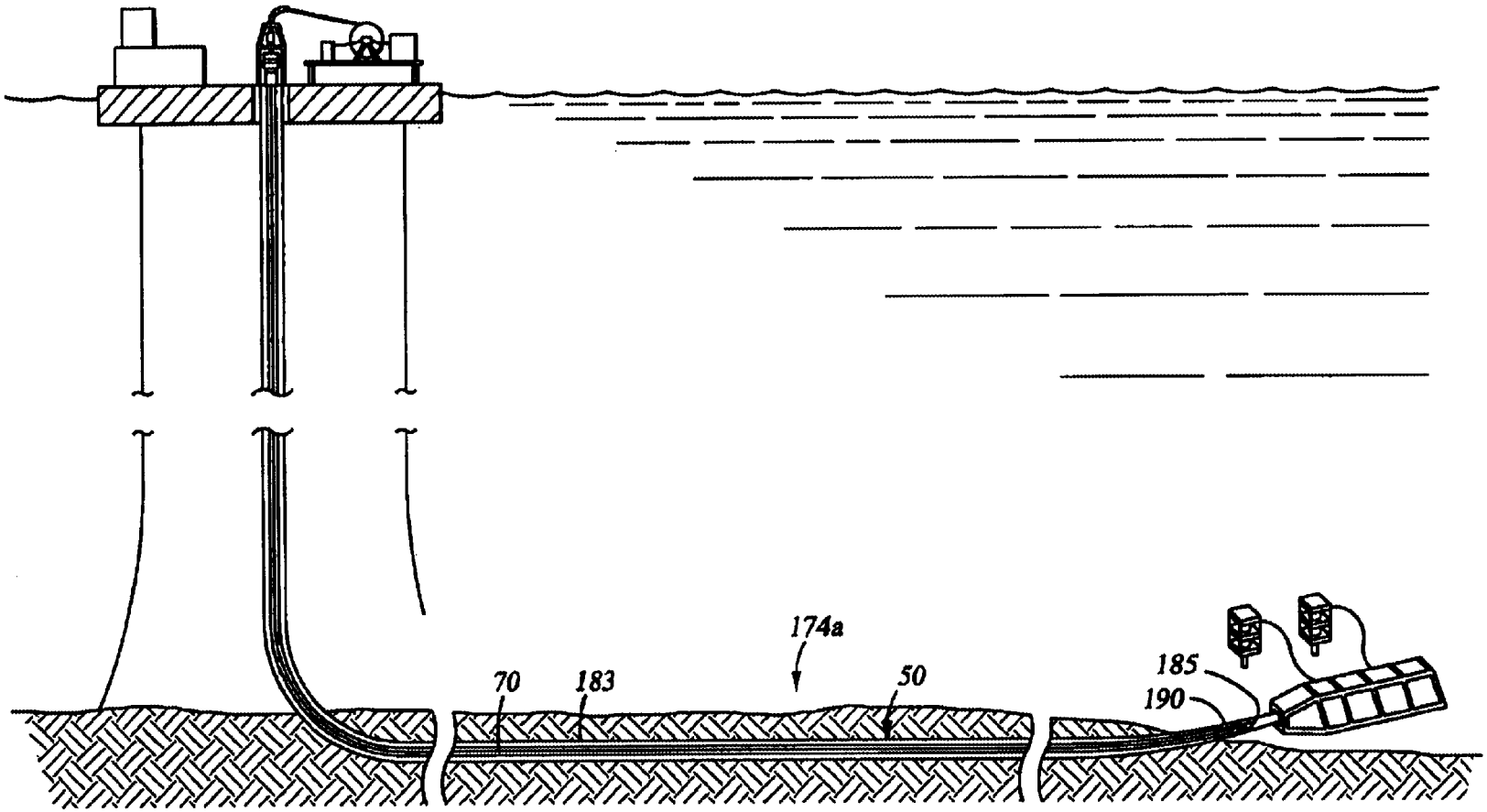
FIG. 16 is an elevational schematic, partly in cross-section, showing a return closed subsea tie back of the present invention having a pair of inner pipes disposed with the flowline.

Referring now to FIG. 16, there is shown another embodiment of the return closed circuit 174*a* with the return line being another inner pipe 183 disposed within flowline 50 with inner pipe 70. The two inner pipes 70, 183 are connected at their downstream end 185 such that fluids can be circulated from the production facility 40 to the downstream end 185 of pipes 70, 183 and then back to production facility 40, all within these two inner pipes 70, 183 that are both disposed inside the flowline 50. Inner pipes 70, 183 can be joined together and inserted into the flowline 50 simultaneously during installation.

Another alternative is to install all electrical and hydraulic control umbilicals within the flowline 50. Where the coiled tubing 80 shown in FIG. 4 is used, the electrical and hydraulic control umbilicals with the conductors may pass through the wall of the coiled tubing 80. The conductors in the walls of the tubing 80 would have connectors at the end of the tubing 80 that connect to all the control systems controlling the trees 18 via the connection 176. Thus, the coiled tubing 80 could be used both for flow assurance and to provide the necessary control umbilicals for the manifold 60 and trees 54. Alternatively, there may be an inner pipe 70 for flow assurance and other inner pipes, such as inner pipe 71, for the control umbilicals.

Referring now to FIGS. 2 and 9–10, to maintain the high temperature of the well fluids flowing from manifold 60 to the production facility 40, the inner pipe 70 may be used to heat the well fluids flowing through the annulus 90 between the inner pipe 70 and outer flowline 70. During the flow of fluids in the flowline 50, hot liquid is pumped down the inner pipe 70 to provide heat input to the fluids, typically the fluids in the flowline are well fluids, flowing through the flowline 50. Such a flow assurance operation would be probably for long term use. Thermodynamically it is better to put a smaller pipe within the flowline rather than a larger pipe around the flowline.

The hot liquids pumped through inner pipe 70 may be hot crude oil or hot water or other practical and available liquid. Hot crude oil is the most likely for open circuit systems 170, such as shown in FIG. 2, where the hot crude oil will mix with the well fluids flowing in the flowline 50. Seawater is the most likely hot liquid for an environmental closed circuit system 172, such as shown in FIG. 9, where the fluid does not mix with the flow in the flowline 50 but can be dumped into the sea water 178. Other fluids that cannot be mixed with the well fluids or sea water may be used with the return closed circuit 174, such as shown in FIGS. 10 and 16.

Hot fluids are particularly pumped through the inner pipe 70 to heat up the well fluids before restarting flow after a shut down. After an extended shutdown of flow in the flowline 50, the well fluids will tend to cool and need to be reheated before restarting flow.

It is most preferred to have inner pipe 70 extend inside the main flowline 50 along its entire length such as shown in FIGS. 9–11. One embodiment includes an inner pipe 70 having a 4" diameter, inside the main flowline having a 12" diameter. Hot water is flowed through the 4" inner pipe 70 to maintain the temperature during flowing conditions and to reheat the flowline 50 to prepare it for restart after a prolonged shutdown. The most preferred is the return closed circuit 174, shown in FIG. 10, or the closed circuit 174*a*, shown in FIG. 16, having one 12" flowline 50 with a 4" inner pipe 70 and 1" of thermotite insulation around the 12" flowline 50, buried 3 feet deep and circulating hot water through the 4" inner pipe 70 and back to the production platform 42.

The above system is cost effective, certainly significantly less (double digit millions of dollars) expensive than the prior art and the thermal efficiency of heating from the hot water circulation is much greater than the prior art. The thermal efficiency is good because the hot water flow takes place inside the 12" flowline 50 and all of the heat conducted out of the 4" inner pipe 70 goes into the well fluids. The prior art dual concentric pipe with an external 20" carrier pipe loses much of its heat to the surrounding seawater and sea floor rather than conducting the heat to the well fluids. Further, the prior art requires much more power. Also, the reheat time after prolonged shutdown may be 12 days for the prior art 20" carrier pipe system as compared to 2 days for the 4" inner pipe system of the present invention, again with significantly less power needed by the 4" inner pipe system.

A pig is no longer necessary to remove wax or hydrates because the inner pipe 70 can provide sufficient heat to heat the well fluids in the flowline 50 thereby maintaining the temperature of the well fluids at a minimum temperature so as to avoid hydrate formation or wax buildup. Thus a pig is not required because there is little or no buildup. If a flow assurance operation is necessary, a downhole tool or chemicals may be used as hereinafter described.

Referring now to FIG. 11, where the inner pipe 70 is lying on the bottom of the flowline, such as at 192, stagnate areas begin to occur because those areas are outside the main flow path of the well fluids. The main flow through the center of the flowline 50 misses the dead areas 192 and causes stagnation of the fluids. Water tends to collect at these low points and electrolytic action causes corrosion of the flowline.

In order to avoid pooling and build-up of water/electrolyte in the stagnant areas at locations 192, the inner pipe 70 can be periodically moved backwards and forwards with flowline 50 using the coiled tubing or snubbing techniques, previously described, in order to disturb and clear the stagnant regions of fluids. Another way to disturb the stagnant areas is to move the inner pipe 70 in a direction normal to the axis of the flowline 50. This can be achieved by pumping slugs of different density fluids down the inner pipe 70 to cause sections of the inner pipe 70 to alternately float and sink. The inner pipe 70 does not have to be moved very far from the inner surface 55 of the flowline 50 to disturb the stagnate areas and cause the well fluids flowing through the flowline 50 to engage the stagnant fluids and remove them by flowing them away. The inner pipe 70 can be moved through the flowline 50 while there are well fluids flowing in the flowline 50 or while the flow is stopped due to the wells being shut in.

Various slugs of fluids might be pumped through the inner pipe to cause a wavy motion in the inner pipe 70 due to a changing of the buoyancy of the inner pipe 70 within the flowline 50. Such fluids include water, drilling fluids, gas, chemicals, methanol, glycol, or any of the other typical oil field fluids that may be available. Each of the fluids provide a different range of densities to change the buoyancy of the inner pipe 70. For example, a slug of gas hundreds of feet long may be introduced inside the inner pipe 70. This would deliberately alter the buoyancy of the inner pipe 70 within the outer flowline 50.

Referring now to FIG. 2 showing an open circuit 170, during the flow of well fluids in the flowline 50, chemicals, such as methanol, can be pumped down the inner pipe 70 to mix with the well fluids in the flowline 50. Chemicals may be needed for a variety of reasons to condition the fluids in the flowline 50, including corrosion inhibition, wax inhibition, and prevention of hydrate formation. As distinguished from the prior art, the chemicals are injected into the flowline 50 through the inner pipe 70 rather than through an external chemical injection line, such as line 26 shown in FIG. 1.

There are many reasons why chemicals may be injected into the well fluids through the inner pipe 70 and into the flowline 50.

Referring now to FIGS. 9 and 10, for example, assume an unplanned shut down of the wells such that the well fluids are no longer flowing through flowline 50 and are cooling down. Pumping ability is lost and there is no circulation through flowline 50. In a closed circuit 172 or 174, hot water can be flowed through the inner pipe 70. In circuit 172 the hot water can flow through the inner pipe 70 and into the sea water environment and heat up the well fluids in the flowline 50. In circuits 174 and 174*a*, hot water can be circulated through the inner pipe 70 to heat up the well fluids. In these closed circuits, the inner pipe 70 is not blocked by the hydrate formation because it is not open to commingling with the well fluids and thus it is possible to circulate because it is not blocked. Because the inner pipe 70 is only full of sea water, it will never become blocked by hydrates. Thus, even though the well fluids may solidify around the inner pipe 70 in the flowline 50, that will not prevent water flow through the inner pipe 70.

In the open circuit 170, everything cools down, both the well fluids in flowline 50 and the fluids in inner pipe 70, allowing hydrates to form. Thus, the inner pipe 70 does not function any more because there is no longer any flow through the inner pipe 70. Thus, the closed circuits 172, 174 are preferred because the inner pipe 70 is connected to an outside environment.

Alternatively, after the shut down, hydrates do not form immediately and it might take 12 to 20 hours for the well fluids to cool down before the hydrates form. The cool down time will depend upon the amount of insulation around the flowline 50. Therefore, there is a window of opportunity during this cool down time to prevent the formation of hydrates before the actual formation of hydrates occurs in flowline 50.

Referring now to FIG. 2, one action that may be taken in an open circuit 170 during the cool down time is to flow chemicals through the inner pipe 70 and into the flowline 50 to mix with the well fluids and prevent the formation of hydrates. Chemicals would flow out of the upstream free end 135 of inner pipe 70 to mix the chemicals with the well fluids in flowline 50. The chemicals condition the flow of well fluids so that the well fluids will not solidify, i.e., form hydrates. Methanol, for example, prevents the formation of hydrates. Thus, after an unplanned shut down, methanol may be pumped down the inner pipe 70 and commingled with well fluids to prevent the well fluids from forming hydrates and blocking the flowline 50.

Referring now to FIG. 11, another alternative is to include a series of valves 194 spaced along the length of the inner pipe 70 at predetermined locations. Particularly using the coiled tubing 80 described with respect to FIG. 4, the valves 194 may be controlled remotely whereby one or more of the valves 194 may be opened at predetermined locations to allow chemicals passing through the inner pipe 70 to pass into the annulus 90 and mix with the well fluids. Further, the valves 194 may be opened periodically along the length of the inner pipe 70 to condition the well fluids. Further, the inner pipe 70 may be filled with chemicals, such that if there is an unscheduled shut down, all of the valves 194 are opened automatically to allow the chemicals to pass into the annulus 90 and mix with the well fluids to prevent formation of hydrates. See U.S. Pat. No. 6,349,763 B1, issued Feb. 26, 2002 and entitled "Electrical Surface Activated Downhole Circulating Sub". It should be appreciated that down hole technology may be used for these valves such as gas lift mandrels, spring loaded valves, and end side pockets.

Alternatively, the inner pipe 70 may be porous along the entire length of the inner pipe 70. The porosity allows the inner pipe 70 to introduce chemicals into the outer pipe 50 along the entire length of inner pipe 70 without having to move the inner pipe 70 axially with respect to flowline 50 or have flow in the flowline 50. The chemicals are able to seep through the porous walls of the inner pipe 70 when the inner pipe 70 is pressurized with the chemical. For example, this can be useful in cases where there has been an unplanned shutdown of flow through the flowline 50 and the fluids cool to a point where there is a risk of forming hydrate blockages. An inhibiting chemical such as glycol or methanol can be introduced through the porous inner pipe 70 along the entire length on the flowline 50 in sufficient quantities to "dose" the flowline fluids and prevent the formation of hydrates.

The inner pipe 70 may be made porous by deliberately introducing mechanically formed pinholes along its length or by the material properties of the inner pipe 70 walls. For example, a composite tube that comprises fibers and epoxy resins is naturally porous to liquids. The degree of porosity is designed to suit the length of the inner pipe 70 such that it is possible for the chemicals to reach all the way to the end of the inner pipe 70.

Preferably, the inner pipe 70 is pre-installed in the flowline 50. When there is an unplanned stoppage of flow in the flowline 50, the fluids can be easily dosed with a chemical along the entire length of the flowline 50 using a small pump supplying chemicals to the porous inner pipe 70. Once the pressure in the inner pipe 70 is higher than the pressure outside it, the chemicals will seep through the walls of the inner pipe 70 as designed. Flow in the annulus 90 is not required. In fact, flow in the annulus 90 may not even be possible because of the blockage. It is also not necessary to move the inner pipe 70 axially relative to the flowline 50.

Referring now to FIG. 2, undesirable solids can form in the flowline 50. Initially, the hot fluids passing through the inner pipe 70 will heat up the well fluids tending to inhibit the coating of the flowline walls 55 with wax, scale, asphaltene, or other undesirable solids. However, assuming that solids have formed on the wall 55 of the flowline 50, the inner pipe 70 may be passed along the interior of the flowline 50 while injecting chemicals out the open end 135 of the inner pipe 70 to remove any buildup around the flowline interior and thus remove the solids.

Referring now to FIG. 5, a variety of tools 130 may be attached to the end 135 of the inner pipe 70 to conduct flow assurance operations. Such tools may be any of the tools in the coiled tubing tool inventory. The tool 130 is a substitute for the pig and is fastened onto the end 135 of the inner pipe 70 and pushed or pulled through the flowline 50. For example, if it was necessary to clean the interior of the flowline 50, a tool can be attached to the end 135 of the inner pipe 70 and the inner pipe 70 passed through the flowline 50 with the tool 130 cleaning the interior 55 of the flowline 70. Such tools may be used to assist in the removal of wax, scale, asphaltene, sand or other undesirables. See also U.S. Pat. No. 6,318,470 B1, issued Nov. 20, 2001 and entitled "Recirculatable Ball-Drop Release Device for Lateral Oil-well Drilling Applications", hereby incorporated herein by reference, which may release downhole tool 130 from coiled tubing 80.

A tool 130, such as a scraper pig, may be attached to the end 135 of the inner pipe 70 and mechanically clean the walls 55 of the flowline 50 versus cleaning them chemically. Scraper pigs can be used to clear out the deleterious such as wax, scale, or asphaltene. Another tool may be a cleaning tool with jets that provide forced fluid against the interior 55 of the flowline 50 to clean it. Other tools, such as drills, may be used on the inner pipe 70 to clear out the solids and to remove wax and other solid buildup on flowline 50. Any one of a whole range of down hole tools might be used.

Hydrate formation requires low temperature and high pressure. If the well fluids can be kept at a high enough temperature, even with a high pressure, hydrates will not form. Alternatively, if even though the well fluids have a low temperature, if the pressure is maintained low enough, hydrates will not form. There must be the right temperature and pressure to form hydrates. In a normal operation, the heat of the well fluids is maintained in the flowline such that the well fluids reach the production facility 40 at a high enough temperature that hydrates cannot form. If hydrates do form in the flowline 50, the hydrates can block flow through the flowline 50. Thus, one solution is to maintain the temperature of the well fluids such as by flowing hot fluid through the inner pipe 70. Another solution is to condition the well fluids by pumping chemicals through the inner pipe 70. Either of these operations may also be used to restart flow in the flowline.

Figure 12:
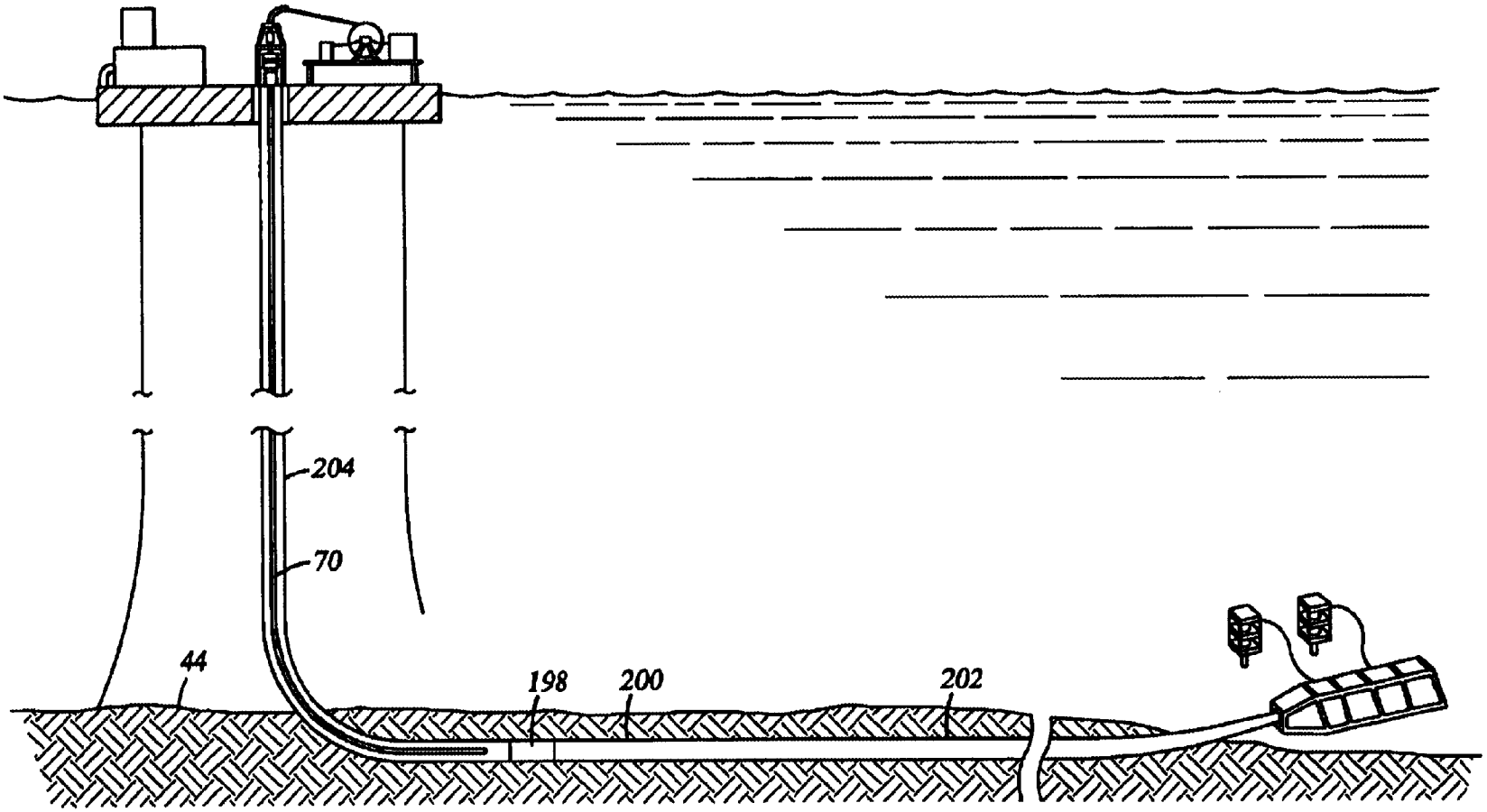
FIG. 12 an elevational schematic, partly in cross-section, showing removal of a hydrate formation using an inner pipe of the present invention.

Depressurization of flowlines is the normal method of melting hydrates for non-deep water flowlines. However, this approach is more difficult to achieve in deepwater flowlines because of the pressure caused by the head of liquid in the riser portion 204 of the flowline 50. Referring now to FIG. 12, there is shown a hydrate formation 198 blocking flow through a flowline 200 in a deep water installation. Flowline 200 includes a horizontal portion 202 and a vertical riser portion 204. One way to remove the hydrates is to "melt" them by depressurizing the flowline 200. Typically the pressure has to be less than 200 psi to prevent hydrate formation.

A problem with depressurization is that a fluid head exists on the well fluids in flowline 200 because of the riser 204 extending from the sea floor 44 to the production facility. Because the depth of the sea bed 44 to the production facility 40 is so high, a substantial head is placed on the well fluids in the horizontal portion 202 of the flowline 200. This head places a substantial pressure on the well fluids. The head of well fluids provides enough pressure so that the pressure of the well fluids is maintained within the hydrate formation pressure region. To get out of the hydrate formation pressure region, it is necessary to depressurize the well fluids and therefore it is necessary to remove the pressure of the head.

As shown in FIG. 12, the inner pipe 70 may be used as a depressurization tube. Any liquid in the inner pipe 70 is removed so that the inner pipe 70 only has gas in it. As an example, assume that there is an unplanned shut down and that the installation has an open circuit 170 and stabilized oil has been flowing down the inner pipe 70. Assume that this is the cool down period after the unexpected shut down. Gas is pumped down the inner pipe 70 because gas can be pumped through the inner pipe 70 over a distance of five miles in eight minutes. Thus, the gas can pass through the inner pipe 70 in a relatively short period of time. Gas passing through a bigger pipe would obviously take a much longer time. The gas passing through the inner pipe 70 can push the liquid out of the riser portion 204 of the flowline 50. Once liquids in the inner pipe 70 have been displaced by gas, the gas can be depressurized. This will cause the liquids remaining in the flowline 50 to flow back into the inner pipe 70. However, since some of the liquids have been displaced out of the riser portion 204 of the flowline 50, the liquid interface in the riser 204 will be lower. This removes or lessens the pressure on the well fluids in the flowline 50 because now there is a lower head. This method will be successful if the volume of the fluids in the inner pipe 70 is equal to or greater than the volume that needs to be displaced from the riser 204 to reduce the head in the riser 204 to a low enough level to melt the hydrates in the flowline 50.

Removing the head takes well fluids out of the hydrate pressure region and allows the heat from the sea water to melt the hydrates over time. Eventually the hydrates will become gas and water. However, the riser 204 may be connected to a flowline 200 that is 20 miles long and the well fluids in the 20-mile length of flowline have now cooled. It will also have water and gas mixed with the oil. Now that the hydrates have been removed, it is necessary to get the well fluids to flow through the flowline 200 again.

To get the flow started, it is necessary to repressurize the well fluids. Unfortunately, when the well fluids are repressurized, the hydrates form again. Thus, even after the head has been removed to depressurize the hydrates, restart of the fluids may merely re-create the hydrates all over again.

The present invention solves this problem because once depressurization has occurred and the hydrate formation has been melted into a liquid, the inner pipe 70, as an open circuit 170, now can be moved into or out of the flowline 50 and chemicals passed through the inner pipe 70 as it moves through the flowline 200. This lays a trail of chemicals all along the flowline 200 as the inner pipe 200 is moved through the flowline 200. The chemicals mix with the well fluids. The inner pipe 70 doses the well fluids with methanol or glycol or some other chemical to prevent hydrate formation as the well fluids are repressurized to begin flow through the flowline 200 again. This then allows the well fluids to be repressurized without the formation of hydrates so that the well fluids can begin to flow. This is a good example of a short term use of the present invention. The inner pipe 70 can then be positioned in its "normal" operating position for flow and the flow restarted without risk of reforming hydrates. When flow starts, hot liquid and chemicals can be injected through the inner pipe 70.

Hydrates may have formed in the flowline 200 prior to insertion of the inner pipe 70. In this case the hydrates can be melted by depressurization and the fluids in the flowline 50 can then be conditioned with a suitable hydrate inhibition chemical pumped through the inner pipe 70 as it moves inside the flowline 50. In a new installation, a permanent inner pipe 70 may be installed and it can be retracted from the flowline 200 to condition the well fluids with chemicals so that hydrates will not form when flow restarts.

This method and the method of removing hydrate formation by heating well fluids are related in that in the latter method, the inner pipe 70 is already in the flowline 200 and in this method, the inner pipe 70 is inserted into the riser 204 and down into the flowline 202 to spread chemicals to avoid hydrate formation.

Sometimes solids such as sand enter flowlines. The ability to remove sand relies on having sufficient flow rate and "hold-up" to carry the sand clear of the flowline. There are currently a number of fluids in the prior art designed to transport solids. These fluids can be used in conjunction with the inner pipe 70. To assist in the action of solids removal, the inner pipe 70 can be moved through the flowline 50 while the "transportation fluid" is being pumped. The transportation fluids have to have a minimum viscosity to pick up and carry the sand.

Referring now to FIG. 13, with reverse circulating using the inner pipe 70, the velocity through the inner pipe 70 might be fast but the recirculation up through the annulus 90 with the larger cross-sectional area and volume will substantially slow down the velocity of the recirculating fluid. To resolve this problem, a second inner pipe 210 is installed. Second inner pipe 210 is inserted into the flowline 50 along with the first inner pipe 70. The second inner pipe 210 is inserted using the same means used to insert the first inner pipe 70. High velocity flow passes through the first inner pipe 70 to activate the sand and then returns through the second inner pipe 210 rather than through the annulus 90 of the flowline 50. The second inner pipe 210 is smaller and has a higher velocity than the annulus 90 of flowline 50 and acts as a good carrier for the sand. Both inner pipes 70, 210 travel in the same direction within the flowline 50. The flow in the inner pipes 70, 210, however, is in opposite directions, one is flowing into the flowline 50 and the other is flowing from the flowline 50 to retrieve the sand. If only the annulus 90 of the flowline 50 is used, the return flow has insufficient velocity to carry the sand. With the second inner pipe 210, there will be no flow through the annulus 90 of the flowline 50. The first inner pipe 70 with the high velocity fluid picks up the sand and the second pipe 210 sucks up the sand.

Referring again to FIG. 5, tool 130 may be an inspection tool for inspecting the flowline 50. If the tool 130 is mounted on the end 156 of the composite coiled tubing 80 shown in FIG. 4 with conductors, including both electrical and data transmission conductors, the data may be transmitted back to the processor 118 through the conductors. The conductors would preferably be fiber optics. Further, it is preferable that flow through the flowline 50 not be stopped.

With tool 130 connected to the coiled tubing shown in FIG. 4, the signal conducting cables in the walls of the coiled tubing 80 can be connected to instrumentation, well known in the art, that can then be used for real-time internal inspection of the flowline 50 by simply moving the inner pipe 70 to the appropriate position along the flowline 50 to allow inspection of any part of the flowline 50. Such instrumentation may include video cameras, calipers, collar locators, gamma ray measurement devices, magnetic resonance devices, sonic devices, radioactive source devices, pressure gauges, temperature gauges, flow meters, resistivity gauges, densitometers, and the like. Tool 130 may be similar to a down hole logging type assembly where the instrumentation is used for inspection.

The inspection tool 130 for inspecting the flowline 50 or acting on the flowline 50 is attached to the end 135 of the inner pipe 70. Being attached to the inner pipe 70, the tool 130 can move forward or backward within the flowline 50 as it sends real-time readings to the processor 118. Thus, if the tool 130 is not taking proper measurements, the operator has control over the tool 130 and can cause the tool 130 to go back over and redo any inspection of a particular section of the flowline 50. For example, a second inspection could include turning up the resolution of the instruments or some other way of varying the inspection real time.

The inner pipe 70 may have to negotiate parts of the flowline 50 that are made from non-bonded flexibles (such as those manufactured by Wellstream.) A non-bonded flexible has a low compression capability. If coiled tubing is inserted through the non-bonded flexible, the tension put into the coiled tubing appears as compression in the flexible. A hundred thousand pounds may be pulled on the coiled tubing. The flexibles may only take 10,000 pounds of compression. This is because the flexibles are made out of interlocking layers complex metal layers.

Further, the non-bonded flexibles themselves have a bend radius, as for example, the catenary shape formed when a non-bonded flexible hangs between two points or when it is draped over an arch. As previously discussed a 5D bend will not allow an existing tractor to pull an inner pipe or an existing injector to push an inner pipe through such a bend. Use of a tractor may not be appropriate through such a configuration due to potential damage to the non-bonded flexible as well as the ability of the tractor to maneuver through bends in the non-bonded flexible.

Thus there are a number of unique problems encountered when a portion of the flowline includes non-bonded flexibles including the compression capability of the flexibles, the tight 5D bend and the capstan friction created.

In such a case the following method and apparatus of the present invention may be used. First, introduce an inner pipe into the non-bonded flexible flowline using a coiled tubing injector or snubbing assembly. This inner pipe is preferably a composite coiled tube. This composite coiled tube has sufficient diameter to provide sufficient resistance to axial bending to allow the coiled tubing injector to cause the inner pipe to travel a substantial distance along the non-bonded flexible flowline. This inner pipe is the first inserted pipe. It is only long enough to travel the relatively short distance of the non-bonded flexible flowline. At least far enough to pass difficult areas such as catenary shapes in non-bonded flexibles. At the end of a non-bonded flexible, there may be a very tight bend in the flowline such as arch or a bend at the top of a rig or a hybrid subsea riser system. A large diameter inner pipe with a high resistance to axial bending will probably have an insufficient minimum bend radius to negotiate such a tight bend (which may have a radius of 5 times the flowline diameter—being the typical bend radius for pigging). This will determine the maximum distance the first inner pipe can travel. This first inner pipe has a flange or similar assembly at one end to enable it to be attached and sealed to the flowline at the coiled tubing injector end.

Second, a second inner pipe is then introduced inside the first inner pipe. This second inner pipe is smaller in diameter and is designed to travel much further in the flowline than the first inner pipe. It also has a much smaller minimum bend radius such that it can negotiate a 5D bend. In such a case it is possible that a coiled tubing injector may not be able to provide the motive force to the second inner pipe to move it over the remote tight bend due to the well-known buckling phenomenon. Therefore, a motive force may be applied to the second inner pipe by pumping a fluid through the first inner pipe in the annulus between it and the second inner pipe such that the hydrodynamic forces generated by the fluid provide the motive force. The annular space between the first and second inner pipes can be adjusted according to the hydrodynamic properties of the fluid pumped and the desired degree of motive force. Returns flow through the annulus formed between the second inner pipe and the non-bonded flexible flowline. Such a method of applying motive force will avoid the buckling phenomenon. Controlling the pumping pressure and flow rate of the pump can control the motive force. Both of the inner pipes can be removed using a coiled tubing injector or snubbing unit.

Figure 14:
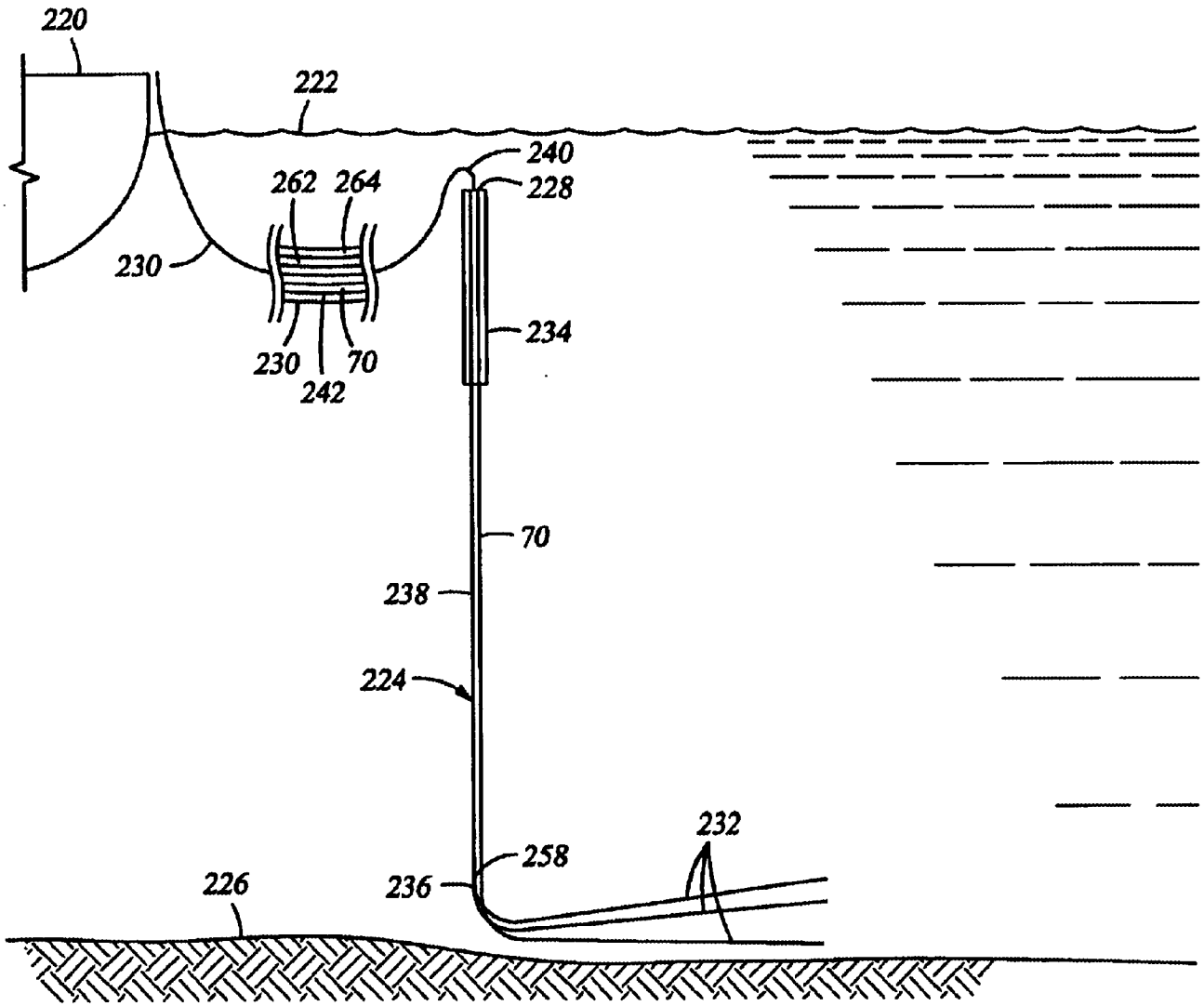
FIG. 14 an elevational schematic, partly in cross-section, a subsea tie back system having a non-bonded flexible using an embodiment of the present invention.
Figure 17:
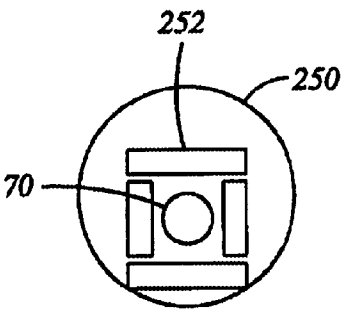
FIG. 17 is a cross-section of a segment of the goose neck shown in FIGS. 14 and 15.
Figure 15:
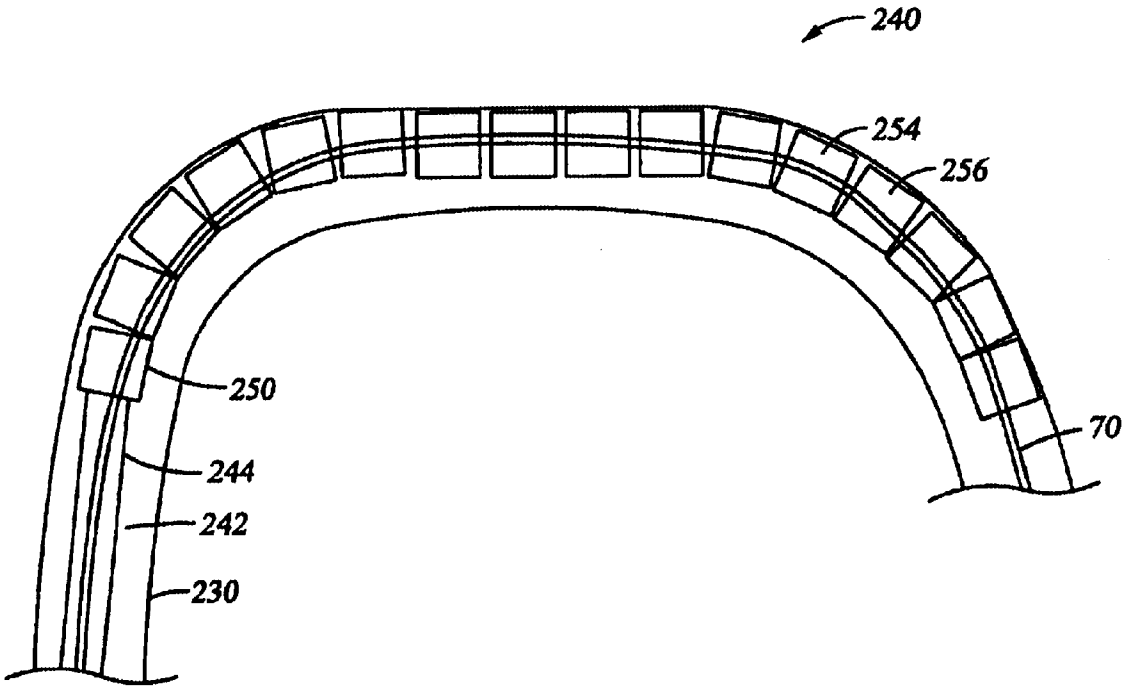
FIG. 15 is a perspective view of a segmented goose neck for use in installing the inner pipe of the present invention.

Referring now to FIGS. 14, 15 and 17, there is an FPSO 220 floating at the water's surface 222 in deep water over 1000 meters A tower riser 224 extends from the sea floor 226 to an upper end 228, which is approximately 40 meters below the surface of the water 222. There is at least one flowlines 230 extending from the FPSO 220 to the upper end 228 of the tower riser 224. There are a number of flowlines 232 which are connected to the lower end of tower riser 224. Tower riser 224 may include a bundle of risers, such as riser 238, extending to the upper end 228. The tower riser 224 may also have a central structural member 234. The bundle includes a plurality of risers, such as riser 238, for production varying in diameter from 4 to 16 inches. The bundle also includes other pipes, including chemical injection pipes and umbilicals. Buoyancy blocks may be attached to tower riser 224 including a buoyancy tank at upper end 228. The lower end 236 is anchored. Flowlines 232 are connected to the lower end of one of the pipes making up tower riser 224.

Flowlines 230 extending from FPSO 220 to the upper end of tower riser 228 are non-bonded flexibles. The non-bonded flexible 230 hangs in a draped subsea arch between FPSO 220 and the upper end of tower riser 224. One type of non-bonded flexible is made by Wellstream.

A 5D steel pipe bend 240 communicates the non-bonded flexible 230 with the upper end 228 of tower riser 224 and communicates the upper end 228 with riser 238. A 5D bend will allow a pig to be sent through the flexibles 230 from the FPSO 220 to the tower riser bottom 236 because all the bends are at least a 5D bend.

However, there is a concern that if there is a hydrate formation in one of the flowlines 232, that there is no flow assurance solution to removing the blockage. As previously described, an inner pipe cannot be inserted through the non-bonded flexible 230 because of the compression capability of the flexible; an inner pipe with a tractor cannot negotiate the tight 5D bend 240 and the capstan friction will prevent an inner pipe from passing through these flowlines.

Referring still to FIGS. 14, 15 and 17, there is shown an apparatus and method of the present invention that overcomes these problems. A flexible gooseneck 250 is attached to the forward end 244 of a liner pipe, such as composite coiled tubing 242. The flexible gooseneck 250, best shown in FIGS. 15 and 17, includes a plurality of rollers 252 mounted interiorally of the gooseneck 250 with the plurality of rollers disposed within individual sections 254, 256 of the gooseneck with section 254, 256 being connected by a type of universal joint (not shown) that will allow section 254 to bend with respect to section 256. This will allow the gooseneck 250 to negotiate 5D bend of arch 240. Segments 254, 256 are jointed to allow the jointed composite tube gooseneck 250 to be inserted through the flexible 230 and to negotiate the bend of arch 240. The rollers 252 on gooseneck 250 overlap. One pair will be slightly inset with respect to the other pair of rollers. Thus, no matter where the inner pipe 70 sets with respect to the rollers 252, it will at least engage one roller. The universal joint will allow one segment to set at a slight angle to the other.

The liner composite coiled tubing 242 with flexible gooseneck 250 on its forward end 244 are inserted into the flexible 230 from the FPSO 220 and are passed through the flexible 230 to the arch 240 using normal coiled tubing techniques with an injector head unit. By way of example, assuming flexible 230 may have a diameter of 8 inches and the liner pipe 242 may have a diameter of 4 inches. The composite coiled tubing 242 is inserted and pushed in from the vessel 220 until the goose neck 250 passes through the bend in the arch 240. The composite coiled tubing 242 does not go around the tight bend of arch 240. Thus, liner pipe 242 and goose neck 250 now line the flexible 230 and the arch 240.

Next, an inner pipe 70, such as coiled tubing 80, is inserted into the composite coiled tubing. The composite coiled tubing 242 resists the compression forces caused by the insertion of the inner pipe 70. The inner pipe 70 also passes through the segmented gooseneck 250 by passing between the rollers 252 that assist the inner pipe 70 to negotiate the bend of arch 240. These rollers 252 eliminate the capstan friction during the insertion of the inner pipe70.

The composite coiled tubing 242 prevents the inner pipe 70 from buckling as it passes through the flexible 230. The inside diameter of the composite coiled tubing 242 has a close fit with the outer diameter of the inner pipe 70 passing through it. The closer the fit, the more compression force that can be applied to the inner pipe 70 because the closer fit prevents the inner pipe 70 from buckling. The composite coiled tubing 242 also protects the flexible 230 from the compression caused by injecting the inner pipe70. Further, the composite coiled tubing 242 also serves the function of introducing the flexible gooseneck 250 through the bend of arch 240.

The inner pipe 70 then passes all the way down tower riser 224 to point 258 where the tower riser 224 is connected to the flowline 232. The inner pipe 70 can pass into flowline 232 if the pipe bends between the riser tower 224 and the flowlines 232 are "kind" enough.

The inner pipe 70 may, for example, be an inch in diameter. The diameter is determined by the size required to negotiate the bend 66 around arch 240. Inner pipe 70 may be an inch and a half in diameter. An inch and a half diameter composite coiled tubing has a three-quarter inch diameter flowbore. The ID of the four inch composite coiled tubing 242 is small enough to prevent the 1½ inch diameter inner pipe 70 from buckling.

To insert and install the inner pipe 70 within the composite coiled tubing 242, the inner pipe 70 would be forced through the composite coiled tubing 242 by an injector head unit. To assist in inserting the inner pipe 70 within the composite coiled tubing 242, fluid may be introduced in the annulus 262 between the composite coiled tubing 242 and inner pipe 70. The introduction of the inner pipe 70 into a fluid passing through the annulus 262 will assist the insertion of the inner pipe 70 and also tend to prevent buckling. Further, the insertion will be much smoother because there is fluid in the annulus 262 between the two composites 242, 70. The fluid then returns through the annulus 264 formed between the composite coiled tubing 242 and inner pipe 70.

In the later life of oilfields, it is often desirable that the flowline system be capable of working with lower flow rates and lower reservoir driving pressures. This is referred to as "turn-down." It is also desirable to avoid the "risk of under-recovery of reserves" where the wells can not be optimally produced because the flowline cannot handle full production. Thus, it is preferred to balance the flowline so as to optimally produce the reserves in the field. The objective is to optimize the cross-sectional flow area of the flowline in accordance with the preferred amount of production of well fluids.

Thus it is desirable to change the cross-sectional area of the flowline over the life of a field to be appropriate for the production from the reservoir. This cross-sectional area needs to be tuned to the production. It may be preferred to have more than one flowline. This allows one of the flowlines to be shut down when production is reduced during the life of the field.

Further, the initial inner pipe 70 having a first diameter may be replaced with a new inner pipe having a second larger diameter thus reducing the annulus flow area 92 of the flowline 50. This smaller annular area 92 then better accommodates the reduced production from the field. Further variations in production parameters can be accommodated by flowing fluids through the inner pipe 70 itself. There is even more flexibility if there is more than one inner pipe 70 inside the flowline 50 allowing one of the inner pipe 70 to be closed to flow or possibly removed.

Another aspect of production involves the separation of gas from the liquids of the production fluids. This step is typically performed on the production platform 40 after the fluids have traveled through outer pipe 50. However, a porous inner pipe 70, such as one discussed above as an alternative embodiment in FIG. 11, may be used to separate the gas from the liquids. For example, the inner pipe 70 may be emptied or filled with a fluid at a lower pressure than the fluids in the annulus 90. As the fluids flow through the flowline 50, the gas at the higher pressure will seep through the walls of and into the porous inner pipe 70. The material characteristics of the inner pipe 70 can be designed depending on the application needed and the materials of the fluids in the flowline 50. In addition, the fluids may also flow through the inner pipe 70 while the gas separates into the annulus 90 through the porous walls of the inner pipe 70. Separating the gas from the other production fluids while in the flowline 50 saves the time and expense involved with using heavy equipment on the platform 40.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An apparatus for assuring the flow of fluids through an outer pipe, the apparatus comprising:

an inner pipe extending through the outer pipe and having a flowbore adapted to flow fluids within said inner pipe;

said flow of fluids through said inner pipe, adapted to assure production flow of hydrocarbons from a wellbore through said outer pipe; and said inner pipe being prevented from entering the wellbore.

2. The apparatus of claim 1 wherein said inner pipe is a jointed pipe.

3. The apparatus of claim 1 wherein said inner pipe is a continuous pipe.

4. The apparatus of claim 3 wherein the continuous pipe is coiled tubing.

5. The apparatus of claim 4 wherein the coiled tubing is metal coiled tubing.

6. The apparatus of claim 4 wherein said coiled tubing is composite coiled tubing.

7. The apparatus of claim 6 wherein said composite coiled tubing includes conductors passing through the wall of said composite coiled tubing.

8. The apparatus of claim 1 wherein, during installation and relative axial movement with the outer pipe, said inner pipe is nearly neutrally buoyant or substantially neutrally buoyant within the fluid in the outer pipe.

9. The apparatus of claim 1 further including fluids flowing through said inner pipe that affect the fluids flowing through the outer pipe.

10. The apparatus of claim 8 wherein said inner pipe taken together with the fluids therein has substantially the same density as the fluids flowing in the outer pipe.

11. The apparatus of claim 8 wherein said inner pipe has the same density of the fluids inside the inner pipe as well as the fluids outside the inner pipe.

12. The apparatus of claim 8 wherein the fluids in the inner pipe are non-miscible, the fluids outside the inner pipe are non-miscible, and the inner pipe is nearly or substantially neutrally buoyant within at lest one of the non-miscible fluids outside the inner pipe.

13. The apparatus of claim 1 wherein the inner pipe extends less than the entire length of the outer pipe.

14. The apparatus of claim 1 wherein the inner pipe extends the entire length of the outer pipe.

15. The apparatus of the claim 1 wherein the inner pipe includes an anchor anchoring the inner pipe within the outer pipe.

16. The apparatus of the claim 15 wherein the anchor frictionally engages the outer pipe.

17. The apparatus of claim 1 further including a connection in the outer pipe for installing the inner pipe within the outer pipe.

18. The apparatus of claim 17 wherein the connection may be located anywhere along the outer pipe.

19. The apparatus of claim 1 further including a propulsion system connected to the inner pipe propelling the inner pipe within the outer pipe.

20. The apparatus of claim 19 wherein the propulsion system is a tractor electrically or hydraulically powered.

21. The apparatus of claim 20 wherein the tractor includes a segmented housing.

22. The apparatus of claim 17 wherein the tractor is hydraulically powered by a power fluid flowed through the inner pipe.

23. The apparatus of claim 22 wherein the power fluid is a foam.

24. The apparatus of claim 1 wherein one end of the inner pipe is open within the outer pipe and allows fluids flowing through the inner pipe to be mixed and commingled with the fluids in the outer pipe.

25. The apparatus of claim 1 wherein the inner pipe extends externally of the outer pipe and allows fluids flowing through the inner pipe to flow through and outside of the outer pipe.

26. The apparatus of claim 1 wherein the inner pipe extends externally of the outer pipe and connects to a return line.

27. The apparatus of claim 1 further including a return nine disposed within the outer pipe along with the inner pipe, the return pipe and inner pipe having ends that communicate to allow circulation through the inner pipe and return pipe.

* * * * *